US012082731B2

(12) United States Patent
Oakley

(10) Patent No.: US 12,082,731 B2
(45) Date of Patent: Sep. 10, 2024

(54) HANGER FOR HANGING PANTS

(71) Applicant: Gary Oakley, Denver, CO (US)

(72) Inventor: Gary Oakley, Denver, CO (US)

( * ) Notice: Subject to any disclaimer, the term of this patent is extended or adjusted under 35 U.S.C. 154(b) by 234 days.

(21) Appl. No.: 17/584,115

(22) Filed: Jan. 25, 2022

(65) Prior Publication Data

US 2022/0233007 A1 Jul. 28, 2022

Related U.S. Application Data

(60) Provisional application No. 63/141,850, filed on Jan. 26, 2021.

(51) Int. Cl.
*A47G 25/48* (2006.01)
*A47G 25/20* (2006.01)
*A47G 25/30* (2006.01)

(52) U.S. Cl.
CPC ..... *A47G 25/487* (2013.01); *A47G 25/20* (2013.01); *A47G 25/30* (2013.01)

(58) Field of Classification Search
CPC ..... A47G 25/48; A47G 25/481; A47G 25/487
See application file for complete search history.

(56) References Cited

U.S. PATENT DOCUMENTS 85,756 A 1/1869 North
638,959 A * 12/1899 Copeland ..... A47G 25/487 D6/326
2,096,717 A 10/1937 Frederick
2,214,536 A * 9/1940 Nelson ..... A47G 25/487 223/96
D126,753 S 4/1941 Xiques
2,288,551 A 6/1942 Shanahan
D183,640 S 9/1958 Van Dusen
3,013,706 A * 12/1961 Morton ..... A47G 25/52 D6/327
D193,746 S 10/1962 Cohen
3,061,155 A 10/1962 Dusen
3,209,967 A 10/1965 Hasselback
D205,567 S 8/1966 Chambers
3,276,645 A 10/1966 Buzzelli
3,343,734 A 9/1967 Merriman
3,485,423 A 12/1969 Rolfe
D220,891 S 6/1971 Charak
(Continued)

OTHER PUBLICATIONS

U.S. Appl. No. 29/770,394, filed Feb. 11, 2021, Oakley.
(Continued)

*Primary Examiner* — Nathan E Durham
(74) *Attorney, Agent, or Firm* — Sheridan Ross P.C.

(57) ABSTRACT

A clothes hanger for hanging pants is disclosed. The hanger includes a hook portion, a clamp portion, and an actuator portion to open the clamp portion. The hook portion is configured to engage and hang from a standard closet rod or other support. Some embodiments include a handle portion that is positioned such that the user may depress the actuator portion with the thumb of the hand holding the hanger to open the clamp of the clothes hanger. Other embodiments of the hanger include padding to help secure the pants within the clamp of the hanger and ensure the user's comfort when pressing the actuator portion. Further, the hanger may include a button-like trigger to allow the user to easily open the clamp to insert the pants into the clamp.

17 Claims, 16 Drawing Sheets

(56) References Cited

U.S. PATENT DOCUMENTS

| | | | | |
|---|---|---|---|---|
| D238,539 | S | | 1/1976 | Rhyne |
| 4,177,841 | A | * | 12/1979 | Meckstroth ..... A47G 25/52 D6/327 |
| D278,867 | S | | 5/1985 | Tendrup |
| 4,565,309 | A | | 1/1986 | Batts |
| D283,273 | S | | 4/1986 | Rhyne |
| 4,579,262 | A | | 4/1986 | Keenan |
| D285,264 | S | | 8/1986 | Miale |
| D309,220 | S | | 7/1990 | Welch |
| D320,700 | S | | 10/1991 | Testa |
| 5,056,670 | A | | 10/1991 | Fine |
| D334,480 | S | | 4/1993 | Dongas |
| D337,209 | S | | 7/1993 | Cardinal |
| D362,553 | S | | 9/1995 | Hoeppner |
| D381,815 | S | | 8/1997 | Louw |
| D386,009 | S | | 11/1997 | von Fabris auuf Mayerhofen |
| 6,006,964 | A | | 12/1999 | White |
| D435,174 | S | | 12/2000 | Grisdale |
| D435,354 | S | | 12/2000 | Skeens |
| D498,934 | S | | 11/2004 | Saito |
| D515,827 | S | | 2/2006 | Steendyk |
| 7,731,068 | B2 | | 6/2010 | Scicluna |
| D679,912 | S | | 4/2013 | Cohen |
| D818,278 | S | | 5/2018 | Kershaw |
| D873,575 | S | | 1/2020 | Oakley |
| D886,473 | S | | 6/2020 | Oakley |

OTHER PUBLICATIONS

Official Action for U.S. Appl. No. 29/649,334, dated Jun. 24, 2019 8 pages Restriction Requirement.

Notice of Allowance for U.S. Appl. No. 29/649,334, dated Sep. 16, 2019 7 pages.

Notice of Allowance for U.S. Appl. No. 29/715,418, dated Jan. 9, 2020 10 pages.

* cited by examiner

HANGER FOR HANGING PANTS

CROSS-REFERENCE TO RELATED APPLICATIONS

This application claims priority and benefits under 35 U.S.C. § 119(e) to U.S. Provisional Patent Application Ser. No. 63/141,850 filed on Jan. 26, 2021, which is incorporated herein in its entirety by reference.

FIELD

The present disclosure relates to a hanger for pants. The hanger includes a clamp portion and is configured to be held and operated with only one hand to allow the user to hold a pair of pants with another hand.

BACKGROUND

Wrinkled clothing, especially wrinkled dress clothes or formal attire, can diminish the wearer's appearance and credibility. While most people do not intend to wear wrinkled dress clothes, certain articles of clothing are difficult to clean and store without introducing wrinkles. Generally, clothes can be either hung or folded to avoid wrinkling. Folding can introduce fold creases, especially in pant legs. Therefore, pants are typically hung on a hanger rather than folded to avoid the creation of wrinkles. Pants can also be difficult to hang without creating some crease or wrinkle due to the hanger construction and intended method of hanging pants.

Most hangers for pants include either a clamp which attaches to the waist band at multiple points or a cross bar that the pants are folded over. When the pants are folded over a cross bar, the pants may become wrinkled. Alternatively, it can be difficult to properly align the waistband of pants such that fold aligns with the seams of the pants. This problem is especially prevalent with pleated pant legs. Further, when the waistband is pinched by the clamps, the waistband may similarly become wrinkled or marred by pinching of the hanger over a small area.

To hang pants using the cross bar style hanger, the user must fold the pants such that they are positioned correctly and then carefully put them on the hanger such that they are still positioned correctly. This action usually requires a flat surface to fold the pants on and support the folded pants while the hanger is aligned with the pants. This series of actions is tedious and takes time and effort.

Accordingly, there is a need for a pants hanger which can be easily clamped onto a pair of pants without introducing wrinkles.

SUMMARY

In one aspect of the disclosure, a hanger for easily hanging pants is provided. The hanger includes a clamp portion which clamps onto a pair of pants. The hanger includes a hook that is configured to engage a support, such as a bracket, a hook on a wall or a door, or a closet rod. Thus, the user may use the clamp portion to engage the pants, then hang the hanger from the support via the hook.

Further, the hanger is configured such that the user may activate the clamp portion with the same hand that is holding the hanger. In one embodiment, the hanger includes a handle portion. The user can hold the hanger by the handle portion and actuate the clamp portion with only one hand. The hanger includes a hook portion at the top end of the hanger, and then transitions into the handle portion. The handle portion is suitably positioned such that the user may press a trigger with their thumb while holding the hanger by the handle portion with the same hand. The trigger opens the clamp portion to receive the pants. Releasing the trigger clamps the pants in the clamp portion.

The hanger may include padding. The padding may cover at least a portion of the handle, the clamp, and the trigger portions of the hanger. This padding may be a foam, a rubber, a plastic, or other suitable material. When present, the padding on the clamp portion provides a frictional resistance to gravity when the pants are hung. Optionally, the padding may cover substantially all of the hanger except a hook portion.

The hanger is preferably formed of a single piece of metal, such as a wire, that has been bent into a desired configuration. However, other materials, such as plastic, carbon fiber, and wood are suitable to form at least portions of the hanger of the present disclosure.

In some embodiments, the hook is approximately centered over the clamp portion. In this manner, the hanger may hang from the support evenly with the clamp portion oriented approximately horizontal.

In a further aspect of the disclosure, another hanger for easily hanging pants is contemplated. In this embodiment, the hanger generally comprises a hook portion, a handle portion, a clamp portion, and an actuator portion. The actuator portion of this embodiment has a button like trigger which enlarges the space the user can press, thereby eliminating possible discomfort and increasing the amount of force the user may translate to the clamp portion.

This embodiment of the hanger is also operable with a single hand. The user holds the handle portion. The user is then able to press the trigger with their thumb to open the clamp portion. The actuator portion if positioned a predetermined distance from the handle portion such that the user can grasp the handle portion with the single hand and operate the trigger with the thumb of the single hand.

The hanger may include padding on some or all of the sections of the hanger as described in the previous embodiment. The padding may serve to increase the frictional resistance to gravity or to create a contacting surface for the clamp portion. Covering the handle portion of the hanger with the padding beneficially makes the hanger easier to grasp and operate by the user.

The trigger of this embodiment may be wood, plastic, rubber, or other suitable material. In one embodiment, the trigger has a generally nail-like configuration. For example, the trigger may include a flat surface for the user to press which is connected to a cylindrical spar. The trigger may be generally circular, and which has a diameter that is greater than the diameter of the spar. In some embodiments the spar is hollow to allow the actuator portion of the hanger to be inserted into the trigger such that a mechanical connection is made. In other embodiments, the spar may be attached with adhesives or other means. In other embodiments, the trigger may be part of the same piece of material as the rest of the hanger.

Another aspect of the disclosure is a hanger for easily hanging pants. In this embodiment, the hanger includes a hook portion, a spine portion, a clamp portion, and a trigger. The hook portion is configured to engage a support, such as a bracket, a hook, or a closet rod as described in previous embodiments.

In this embodiment, the user is still able to operate the hanger with a single hand while maneuvering a pair of pants with the other hand. More specifically, the user can hold the spine portion or the hanger and then slide the pants legs into the clamp portion.

The clamp portion has two legs connected by a lower bend. The first leg begins at the spine portion and is generally straight or linear. In one embodiment, the lower bend is slightly greater than 180 degrees, such that the second leg extends towards the first leg. The second leg extends generally linearly to a turn where the second leg bends outwards away from the first leg. In this manner, a portion of the second leg defines a sloped engagement portion adapted to guide the pants into the clamp portion.

In this embodiment, the user hangs the pants over the second leg once the pants have been inserted into the clamp portion. Optionally, at least one of the first leg and the second leg may have padding as discussed above. In this embodiment, the user would insert the pants through the clamp portion and then hang the pants while they are clamped between the first leg and the second leg of the hanger.

In at least one embodiment, the hook is approximately centered over the clamp portion. In this manner, when the hanger is hung from the support, the hanger the clamp portion will be oriented approximately horizontal.

In yet another aspect of the disclosure, another hanger for easily hanging a pair of pants is contemplated. In this embodiment, the hanger comprises a hook portion, a spine portion, a clamp portion, and an actuator portion of another embodiment of the present disclosure.

The hanger portion includes a hook configured to engage a support, such as a bracket, a hook on a wall or a door, or a closet rod. The hook transitions into the spine portion which connects the clamp portion to the hook. In at least one embodiment, the hook is approximately centered relative to the clamp portion.

The clamp portion has a first leg and a second leg. The first and second legs are generally linear and co-planar. In one embodiment, the legs are approximately parallel and connected by a lower bend. Optionally, the lower bend is approximately 180 degrees. Alternatively, the second leg is angled toward the first leg such that a free end of the second leg is separated from the first leg by a distance that is less than a distance separating the first and second legs proximate to a lower bend of the clamp portion.

The second leg ends at a turn. The actuator portion extends from the turn. In one embodiment, the actuator portion extends upwardly from the turn. Optionally, the actuator portion is oriented approximately vertically.

In this embodiment, the user may operate the hanger with one hand while holding a pair of pants. The user holds the spine section and presses the actuator portion with their thumb. The force on the actuator portion opens the legs of the clamp and allows the user to slide the pants legs through the clamp legs. The user then releases the actuator portion.

In one embodiment, the hanger does not have padding. In this embodiment, the user operates the hanger trigger with their thumb as described above, and then folds the pants over the second leg of the hanger once the actuator portion is released. The user then engages a support, such as a bracket, a hook on a wall or a door, or a closet rod with the hook of the hanger to hang the pants.

In another embodiment, at least the clamp portion of the hanger has padding as described above in other embodiments. In this embodiment, the user presses the actuator portion to open the clamp legs. The user then inserts the ends of pants legs between the legs of the clamp portion. The user then releases the actuator portion and the clamp legs close together. The pants legs are then clamped between the clamp legs such that the pants do not slide down. The user then engages a support with the hook to hang the pants. The support may be a bracket, a hook on a wall or a door, or a closet rod.

One aspect of the present disclosure is a hanger for pants that is adapted to engage a support. The hanger generally includes: (1) a hook portion to engage the support; (2) a handle portion connected to the hook portion, the hook portion being positioned above the handle portion when the hook portion is engaged to the support; (3) a clamp portion connected to the handle portion, comprising: (a) a first leg connected to the handle portion, the handle portion being positioned above the clamp portion when the hook portion is engaged to the support; (b) a second leg extending proximate to the first leg; and (c) a lower bend connecting the first leg to the second leg, the first leg and the second leg being biased into a closed position by the lower bend such that a clamping force is created to hold the pants between the first leg and the second leg; and (4) an actuator portion connected to the second leg and including a trigger, the actuator portion being configured to move the clamp portion into an open position in response to a force applied in a lateral dimension to the trigger, the force causing the second leg to move in the lateral dimension away from the first leg.

In one embodiment, the actuator portion includes a post extending from the second leg. In some embodiment, the post extends in a vertical dimension. Optionally, a spar extends from the post. The spar may extend in a lateral dimension. In some embodiments, the spar is oriented at an oblique angle relative to the second leg of the clamp portion. The spar may be positioned above the handle portion when the hook portion is engaged to the support.

The trigger may extend in the vertical dimension from the spar. Alternatively, the trigger is oriented in a horizontal dimension relative to the spar. Optionally, the trigger is approximately circular such that the trigger extends above and below the spar. The trigger may be connected to an end of the spar opposite to the post.

In one embodiment, in the closed position a first turn at the beginning of the first leg is spaced a first distance from a second turn at the end of the second leg. In the open position the first turn is spaced a second distance from the second turn. The second distance is greater than the first distance.

The handle portion optionally comprises a first arm connected to the hook portion by a neck, a second arm extending proximate to the first arm, and an upper bend connecting the first arm to the second arm.

In one embodiment, the first arm is approximately parallel to the second arm. Additionally, or alternatively, the first arm and the hook portion define a vertical plane. The second arm may be approximately parallel to the first leg. The second arm and the first and second legs are optionally positioned on a first side of the vertical plane. In another embodiment, a spar of the actuator portion extends from the first side of the vertical plane to a second side of the vertical plane.

The handle portion may be spaced from the clamp portion by a spine extending from the second arm downwardly to the first leg. The spine is optionally oriented in a vertical dimension.

The first arm has a first length and the second arm has a second length. In one embodiment, the second length is greater than the first length. Additionally, the first leg optionally has a leg length that is greater than the second length of the second arm.

The hanger may be formed of a single piece of a metal. In one embodiment, at least the first leg and the second leg have a cover of a compressible material. Optionally, the handle portion is covered with a compressible material.

In one embodiment, the lower bend extends between approximately 176° and approximately 184°. The first leg and the second leg may be approximately coplanar. Additionally, or alternatively, the first leg and the second leg are generally linear.

In one embodiment, the first leg is approximately parallel to the second leg. Alternatively, in another embodiment, one of the first and second legs has a curve or a bend.

Optionally, the hook portion is approximately centered relative to the clamp portion. For example, an uppermost portion of the hook of the hook portion may be approximately centered relative to a length of the first leg of the clamp portion. In this manner, the clamp portion may be oriented approximately horizontal when the hook portion is engaged to the support.

Another aspect of the present disclosure is a hanger for a pair of pants that is adapted to hang from a support, comprising: (1) a hook to engage the support; (2) a neck extending downwardly from the hook; (3) a handle portion connected to the neck by a first turn, comprising: (a) a first arm extending from the first turn; (b) an upper bend extending in a lateral dimension from the first arm; and (c) a second arm extending from the upper bend proximate to the first arm, the handle portion being oriented approximately horizontally when the hanger is hanging from the support; (4) a spine connected to the second arm by a second turn, the spine extending downwardly below the second arm; (5) a clamp portion connected to the spine by a third turn, comprising: (a) a first leg extending from the third turn; (b) a lower bend extending in the lateral dimension from the first leg; and (c) a second leg extending from the lower bend proximate to the first leg, the clamp portion being oriented approximately horizontally below the handle portion when the hanger is hanging from the support; (6) a post connected to the second leg by a fourth turn; (7) a spar connected to the post by a fifth turn; and (8) a trigger connected to the spar. The lower bend is adapted to bias the second leg toward the first leg to a closed position of the clamp portion. In use, a force applied in the lateral dimension to the trigger will cause at least a portion of the second leg to move in the lateral dimension away from the first leg into an open position of the clamp portion.

In one embodiment, in the closed position the fourth turn is a first distance from the third turn. The fourth turn is a second distance from the third turn in the open position, the second distance being greater than the first distance.

In one embodiment, the upper bend and the lower bend extend between approximately 170° and approximately 190°.

The trigger is positioned no more than a predetermined distance from the handle portion such that a user may operate the trigger and grasp the handle portion with one hand. More specifically, the post, the spar, and the trigger may have any orientation and geometry to position the trigger no greater than the predetermined distance from the handle portion.

In some embodiments, the post extends generally upwardly from the second leg. For example, the post may be approximately orthogonal to the second leg. However, in other embodiments, the post is oriented at an oblique angle to the second leg.

Additionally, or alternatively, in some embodiments the post is generally linear. Optionally, the post is arcuate or curved.

In at least one embodiment, the spar extends from the post in a lateral dimension above the handle portion when the hanger is hanging from the support. However, the spar may have other orientations to position the trigger no more than the predetermined distance from the handle portion. In some embodiments, the spar extends from the post at an oblique angle relative to the lateral dimension.

In some embodiments the spar is generally linear. Alternatively, the spar is arcuate or curved.

Optionally, the trigger is approximately orthogonal to the spar. Alternatively, the spar is oriented at an oblique angle to the spar.

In some embodiments, the trigger extends from the spar in the vertical dimension. In other embodiments, the trigger extends from the spar in the horizontal dimension and approximately orthogonal to the lateral dimension.

In some embodiments, the hook is approximately centered relative to a mid-point of the clamp portion. In this manner, the clamp portion may be oriented approximately horizontal when the hook is engaged to the support.

One specific embodiment of the present disclosure is a hanger for pants that is adapted to engage a support, comprising: a hook portion to engage the support; a handle portion connected to the hook portion, wherein the hook portion is positioned above the handle portion when the hook portion is engaged to the support; a clamp portion connected to the handle portion, comprising: a first leg connected to the handle portion, wherein the handle portion is positioned above the clamp portion when the hook portion is engaged to the support; a second leg extending proximate to the first leg; and a lower bend connecting the first leg to the second leg, the first leg and the second leg being biased into a closed position by the lower bend such that a clamping force is created to hold the pants between the first leg and the second leg; and an actuator portion connected to the second leg and including a trigger, wherein the actuator portion is configured to move the clamp portion into an open position in response to a force applied in a lateral dimension to the trigger, the force causing the second leg to move in the lateral dimension away from the first leg.

In some embodiments, the actuator portion includes a post extending from the second leg. Optionally, the post extends in a vertical dimension away from the second leg. The post may be approximately orthogonal to the second leg. In other embodiments, the post is oriented at an oblique angle relative to the second leg.

The actuator portion may also include a spar extending from the post. In some embodiments, the spar is approximately orthogonal to the post. Optionally, the spar extends in the lateral dimension. Alternatively, the spar may be oriented at an oblique angle relative to the lateral dimension. In at least one embodiment the spar is positioned above the handle portion when the hook portion is engaged to the support.

In some embodiments the trigger extends in the vertical dimension from the spar. Optionally, the trigger is approximately orthogonal to the post. In other embodiments, the trigger is oriented at an oblique angle to the post.

In various embodiments, in the closed position a first turn at the beginning of the first leg is spaced a first distance from a second turn at the end of the second leg, and wherein in the open position the first turn is spaced a second distance from the second turn, the second distance being greater than the first distance.

In some embodiments, the handle portion comprises a first arm connected to the hook portion by a neck; a second arm extending proximate to the first arm; and an upper bend connecting the first arm to the second arm. In various embodiments, the first arm is approximately parallel to the second arm, and the first arm and the hook portion define a vertical plane, and the second arm is approximately parallel to the first leg, wherein the second arm and the first and second legs are on a first side of the vertical plane, and a spar of the actuator portion extends from the first side of the vertical plane to a second side of the vertical plane. In some embodiments, the handle portion is spaced from the clamp portion by a spine extending from the second arm downwardly to the first leg, the spine oriented in a vertical dimension. In various embodiments, the first arm has a first length and the second arm has a second length that is greater than the first length, and the first leg has a leg length that is greater than the second length of the second arm.

In various embodiments, the lower bend extends between approximately 176° and approximately 184°. In some embodiments, one of the first and second legs has a curve or a bend. In various embodiments, the hanger is formed of a single piece of a metal.

In some embodiments, the hook portion is approximately center relative to a length of the clamp portion. In this manner, the weight of the hanger is approximately centered relatively to the support when the hook portion is engaged to the support.

Another specific embodiment of the present disclosure is a hanger for receiving a garment, comprising: a body extending from a first end to a second end, the body having a hook portion at the first end, wherein the hook portion defines a first vertical plane and is configured to engage a support; an actuator portion at the second end, wherein the actuator portion traverses the first vertical plane; and a clamp portion between the hook portion and the actuator portion, wherein the clamp portion has a first leg and a second leg joined at a lower bend, and wherein the first and second legs define a horizontal plane that is perpendicular to the first vertical plane such that displacement of said actuator portion moves the second leg away from the first leg to receive a garment.

In some embodiments, the body comprises a handle portion between the hook portion and the clamp portion, wherein the handle portion has a first arm and a second arm joined at an upper bend, and the first and second arms are parallel to each other such that the handle portion is configured to receive a hand of a user while the actuator portion is configured to receive a thumb of the user to displace the actuator portion.

In various embodiments, the body comprises a spine extending upwardly from the first leg of the clamp portion to the handle portion; and a post extending upwardly from the second leg of the clamp portion to the actuator portion, wherein the post is longer than the spine such that a user can displace the actuator portion with a thumb while grasping the handle portion. The actuator portion is adapted to be no more than a predetermined distance from the handle portion to facilitate one-handed operation of the actuator portion.

In various embodiments, the spine and the post form a second vertical plane that is perpendicular to the first vertical plane.

In some embodiments, a neck of the hook portion is a first distance from the second vertical plane, the upper bend is a second distance from the second vertical plane, and the lower bend is a third distance from the second vertical plane, wherein the third distance is greater than the second distance, and the second distance is greater than the first distance.

In various embodiments, the hanger further comprises a padding material that covers at least a portion of the body.

In some embodiments, the hook portion comprises a neck extending from the handle portion to a hook at the first end, and the neck and the hook define the first vertical plane. In at least one embodiment, the hook portion is formed such that it is approximately centered relative to the clamp portion. In this manner, the clamp portion may be oriented approximately horizontally when the hanger is hanging from the support by the hook portion.

In various embodiments, the clamp portion and the second arm of the handle portion are positioned on one side of the first vertical plane, and a trigger of the actuator portion is positioned at the second end of the body and is positioned on an opposing side of the first vertical plane. In some embodiments, the trigger is a button that has a larger cross-sectional diameter than the body and is connected to the second end of the body.

Yet another particular embodiment of the present disclosure is a hanger for a pair of pants that is adapted to hang from a support, comprising a hook to engage the support; a neck extending downwardly from the hook; a handle portion connected to the neck by a first turn, comprising a first arm extending from the first turn; an upper bend extending in a lateral dimension from the first arm; and a second arm extending from the upper bend proximate to the first arm, wherein the handle portion is oriented approximately horizontally when the hanger is hanging from the support; a spine connected to the second arm by a second turn, the spine extending downwardly below the second arm; a clamp portion connected to the spine by a third turn, comprising a first leg extending from the third turn; a lower bend extending in the lateral dimension from the first leg; and a second leg extending from the lower bend proximate to the first leg, wherein the clamp portion is oriented approximately horizontally below the handle portion when the hanger is hanging from the support; a post connected to the second leg by a fourth turn, the post extending upwardly from the second leg, wherein the lower bend biases the second leg toward the first leg to a closed position of the clamp portion where the fourth turn is a first distance from the third turn; a spar connected to the post by a fifth turn, the spar extending in the lateral dimension above the handle portion when the hanger is hanging from the support; and a trigger connected to the spar, wherein a force applied in the lateral dimension to the trigger will cause at least a portion of the second leg to move in the lateral dimension away from the first leg into an open position where the fourth turn is a second distance from the third turn, and the second distance is greater than the first distance. In at least one embodiment, the hook is approximately centered relative to a length of the clamp portion.

It will be appreciated that various methods of manufacturing can be utilized to produce the various embodiments of the hanger described herein. In some embodiments, the hanger is a continuous body such as a wire than is bent and formed at various points along the body to produce the resulting hanger. The body can be bent manually using a tool such as pliers or automatically or semi-automatically using a machine such as a CNC wire bender. Thus, in some embodiments, a body extends between a first end and a second end, the hook portion at the first end is bent to form the hook of the hook portion such that the hook can engage a support as described herein. A neck extends downward from the hook, and the body is bent at the end of the neck to form a first turn. The handle portion extends from the first turn where the handle portion comprises a first arm that extends from the first turn to an upper bend where the body is folded back upon itself, and a second arm extends from the upper bend approximately parallel to the first arm. At the end of the second arm, the body is bent downward at a second turn, and the body extends downward along a spine. Then at an end of the spine, the body is bent at a third turn.

The clamp portion extends from the third turn where the clamp portion comprises a first leg that extends from the third turn in a direction that is approximately parallel to the first and second arms. The body is bent at a lower bend, which joins the first leg to a second leg. The body is generally folded upon itself such that the second leg is parallel to the first leg. The body is further bent at an end of the second leg to form a fourth turn. A post extends upwardly from the fourth turn, and the body is again bent at the end of the post at a fifth turn. A spar extends in a lateral dimension that is perpendicular to both the second leg as well as a vertical dimension. The spar forms part of the actuator portion. The body is bent at the end of the spar at a sixth turn. A trigger extends upwardly from the sixth turn to provide a location for a user's thumb to displace the actuator portion and move the second leg away from the first leg to receive all or part of a garment such as pants. The body is generally continuous from a first end to a second end, but it will be appreciated that this can encompass embodiments where an enlarged spherical stop can be positioned to the first end of the body to retain the hook on the support. Similarly, an enlarged trigger can be positioned at the second end of the body to provide a larger area to receive a user's thumb or other body part to displace the actuator portion. In a manufacturing process, the body is cut at the second end to begin manufacturing the next hanger. It will be appreciated that the process can be performed in a reverse fashion where the first end would be cut to begin manufacturing the next hanger. It will also be appreciated that embodiments of the present disclosure are generally described as being operably by a user's right hand, but embodiments of the present disclosure can be mirrored such that the hanger is operated by a user's left hand.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements, components, etc. in this Summary. Additional aspects of the present disclosure will become more clear from the Detailed Description, particularly when taken together with the drawings.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

The term "a" or "an" entity, as used herein, refers to one or more of that entity. As such, the terms "a" (or "an"), "one or more" and "at least one" can be used interchangeably herein.

Unless otherwise indicated, all numbers expressing quantities, dimensions, conditions, ratios, ranges, and so forth used in the specification and claims are to be understood as being modified in all instances by the term "about" or "approximately". Accordingly, unless otherwise indicated, all numbers expressing quantities, dimensions, conditions, ratios, ranges, and so forth used in the specification and claims may be increased or decreased by approximately 5% to achieve satisfactory results. Additionally, where the meaning of the terms "about" or "approximately" as used herein would not otherwise be apparent to one of ordinary skill in the art, the terms "about" and "approximately" should be interpreted as meaning within plus or minus 5% of the stated value.

All ranges described herein may be reduced to any sub-range or portion of the range, or to any value within the range without deviating from the invention. For example, the range "5 to 55" includes, but is not limited to, the sub-ranges "5 to 20" as well as "17 to 54."

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description, Abstract, and Claims themselves.

BRIEF DESCRIPTION OF THE DRAWINGS

The accompanying drawings, which are incorporated in and constitute a part of the specification, illustrate embodiments of the disclosed system and together with the general description of the disclosure given above and the detailed description of the drawings given below, serve to explain the principles of the disclosed system(s) and device(s).

Figure 1A:
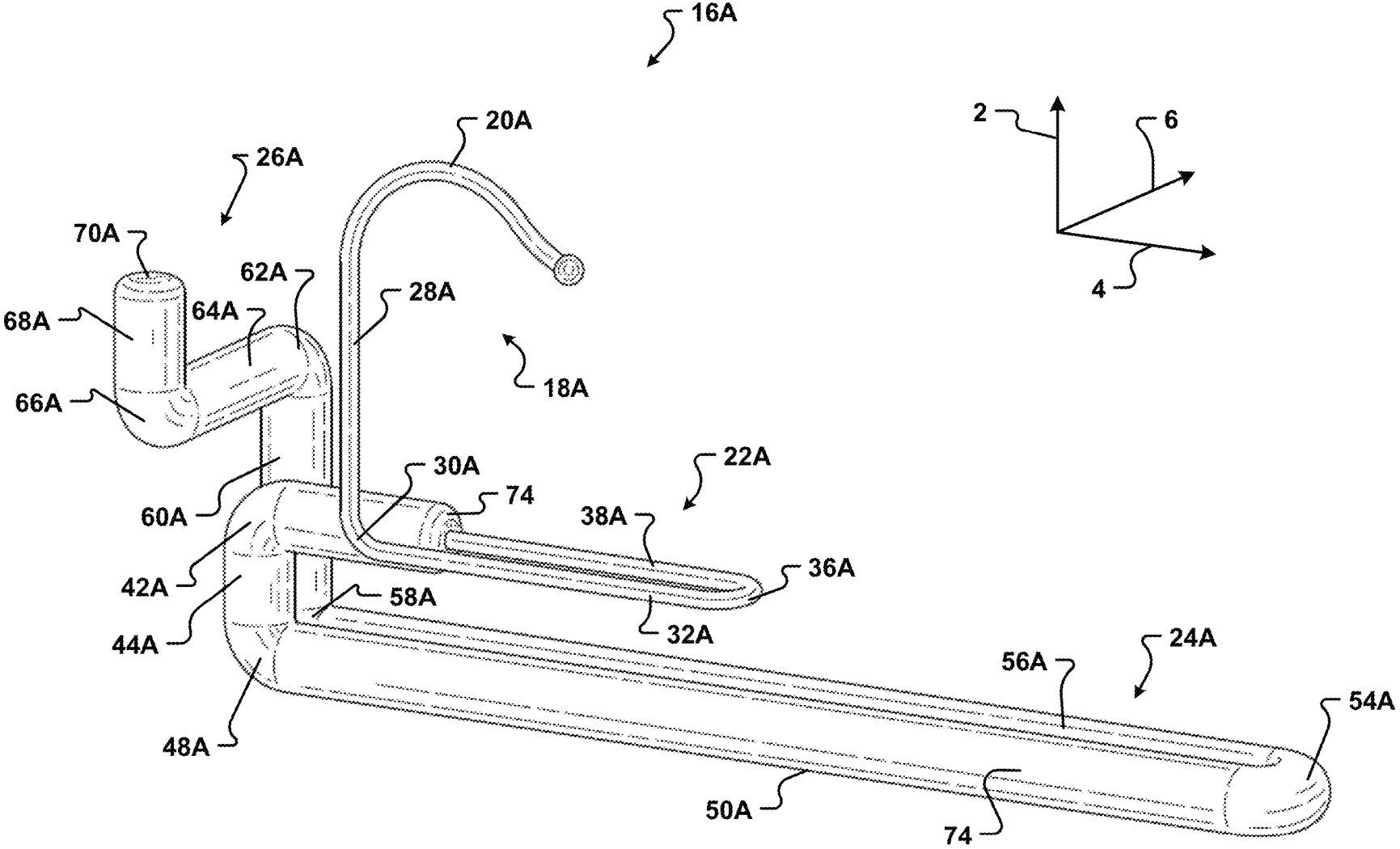
FIG. 1A is a perspective view of one embodiment of a pants hanger having padding and illustrated a clamp portion of the pants hander is a closed position.
Figure 1B:
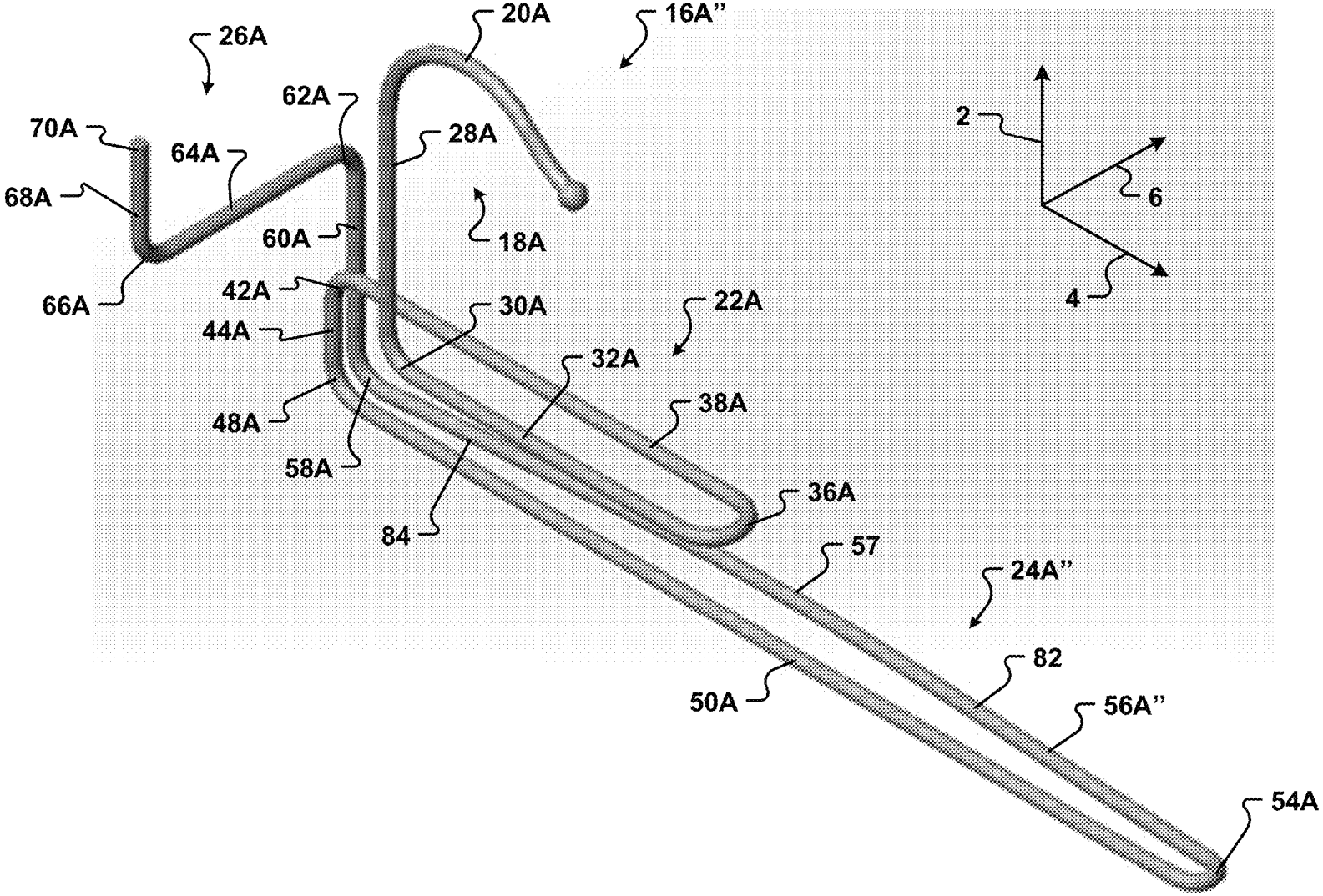
FIG. 1B is a perspective view of a pants hanger similar to the pants hanger of FIG. 1A and including a leg with a bend or curve and with the padding removed for clarity.

The drawings are not necessarily (but may be) to scale. In certain instances, details that are not necessary for an understanding of the disclosure or that render other details difficult to perceive may have been omitted. It should be understood, of course, that the disclosure is not necessarily limited to the embodiments illustrated herein. As will be appreciated, other embodiments are possible using, alone or in combination, one or more of the features set forth above or described below. For example, it is contemplated that various features and devices shown and/or described with respect to one embodiment may be combined with or substituted for features or devices of other embodiments regardless of whether or not such a combination or substitution is specifically shown or described herein.

The following is a listing of components according to various embodiments of the present disclosure, and as shown in the drawings:

| Number | Component |
|---|---|
| 2 | Vertical axis |
| 4 | Horizontal (or longitudinal) axis |
| 6 | Lateral axis |
| 8 | Vertical plane |
| 10 | First side of plane |
| 12 | Second side of plane |
| 14 | Support or closet rod |
| 16 | Hanger |
| 18 | Hook portion |
| 20 | Hook |
| 22 | Handle portion |
| 24 | Clamp portion |
| 26 | Actuator portion |
| 28 | Neck |
| 30 | First turn |
| 32 | First arm |
| 34 | First length of first arm |
| 36 | Upper bend |
| 38 | Second arm |
| 40 | Second length of second arm |
| 42 | Second turn |
| 44 | Spine |
| 46 | Spine height |
| 48 | Third turn |
| 50 | First leg |
| 52 | Length of first leg |
| 54 | Lower bend |
| 56 | Second leg |
| 57 | Leg Bend |

-continued

| Number | Component |
|---|---|
| 58 | Fourth turn |
| 59 | Distance between the third and fourth turn |
| 60 | Post |
| 61 | Post height |
| 62 | Fifth turn |
| 64 | Spar |
| 66 | Sixth turn |
| 68 | Trigger |
| 69 | Distance between handle and the trigger |
| 70 | Free end of trigger |
| 72 | Shaft of trigger |
| 74 | Padding |
| 76 | Guide |
| 78 | Direction of force |
| 80 | Direction of movement |
| 82 | First portion of second leg |
| 84 | Second portion of second leg |

DETAILED DESCRIPTION

Referring now to FIGS. 1A-5, embodiments of a hanger 16A of the present disclosure are generally illustrated. The hanger 16A generally includes a hook portion 18A, a handle portion 22A configured to be grasped by the user to hold the hanger 16A, a clamp portion 24A that is configured to engage a pants leg, and an actuator portion 26A for opening and closing the clamp portion 24A. FIG. 1A also shows a directional axis having a vertical axis 2, a horizontal (or longitudinal) axis 4, and a lateral axis 6. The axes 2, 4, 6 are orthogonal to one another.

The hanger 16A begins with the hook portion 18A. The hook portion 18A has a free end which then transitions into a bent portion or hook 20A for engaging a closet rod. The hook 20A is configured to engage a support 14, such as (but not limited to) a bracket, a hook on a wall or a door, or a closet rod. In one embodiment, the hook 20A is generally arcuate. However, other configurations of the hook are contemplated.

Figure 3A:
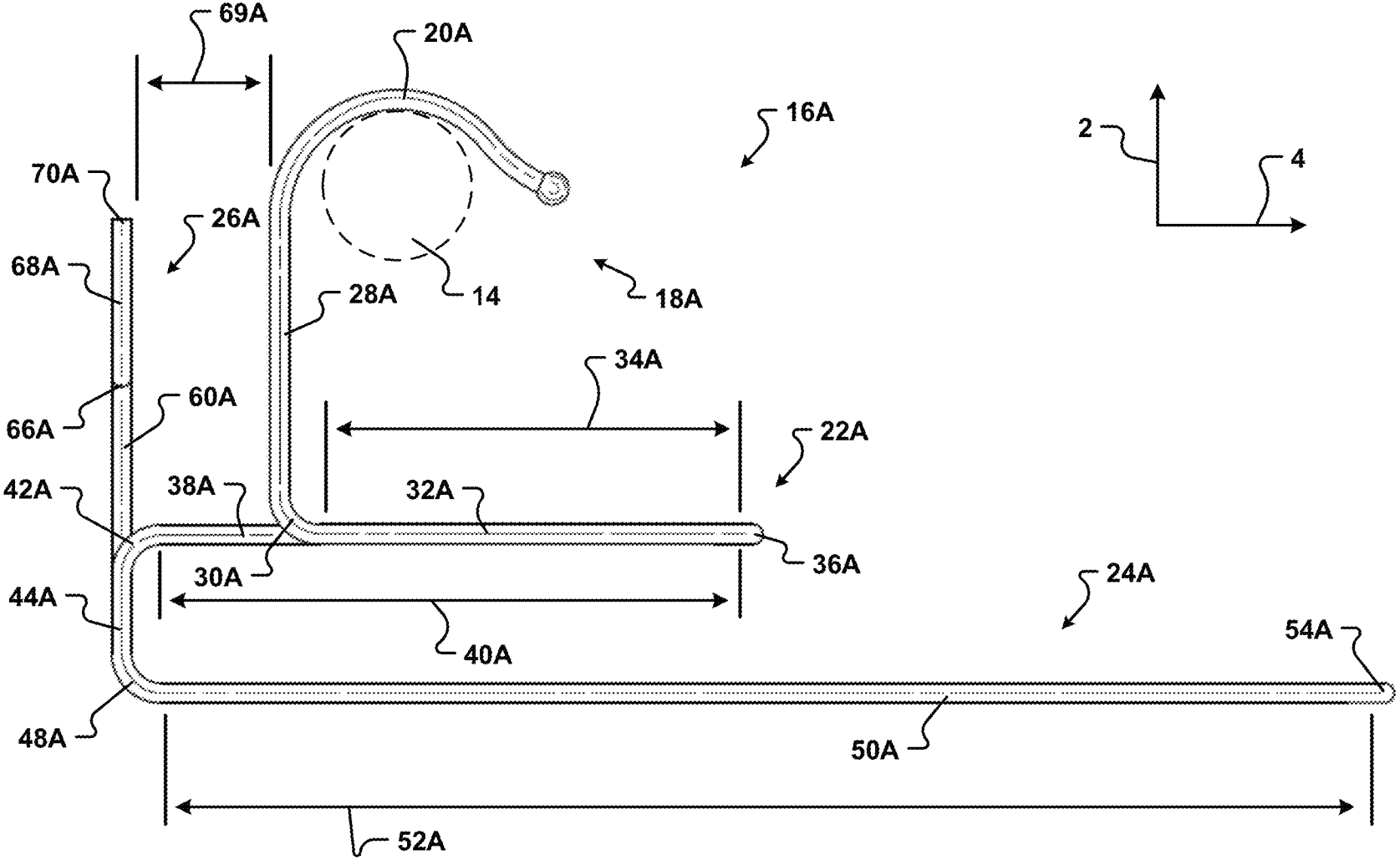
FIG. 3A is a front elevation view of the pants hanger shown in FIG. 2.
Figure 3B:
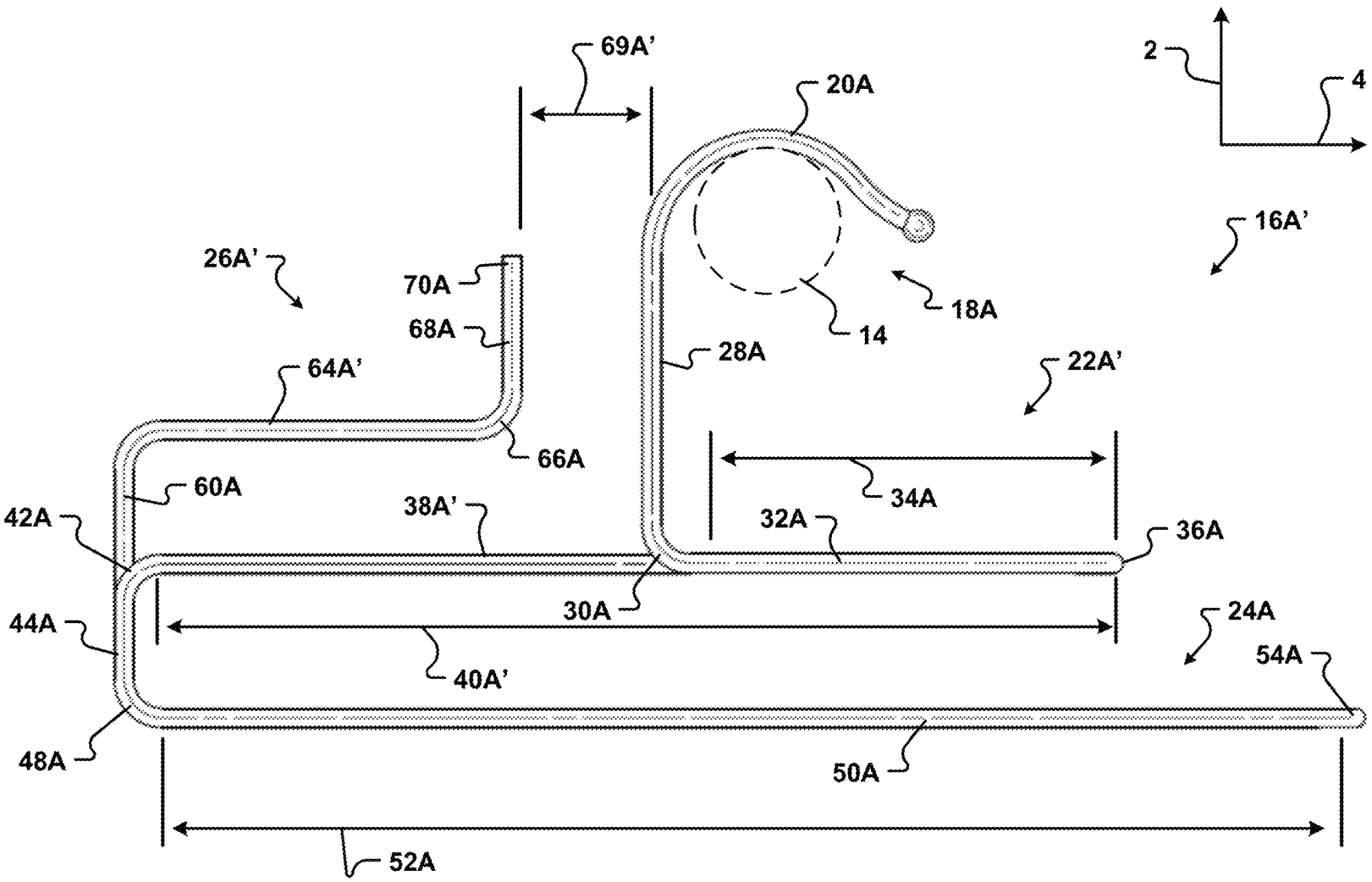
FIG. 3B is a front elevation view of another embodiment of the pants hanger similar to the pants hanger of FIG. 2 and including a hook that is approximately centered along a length of a clamp portion of the hanger.
Figure 4A:
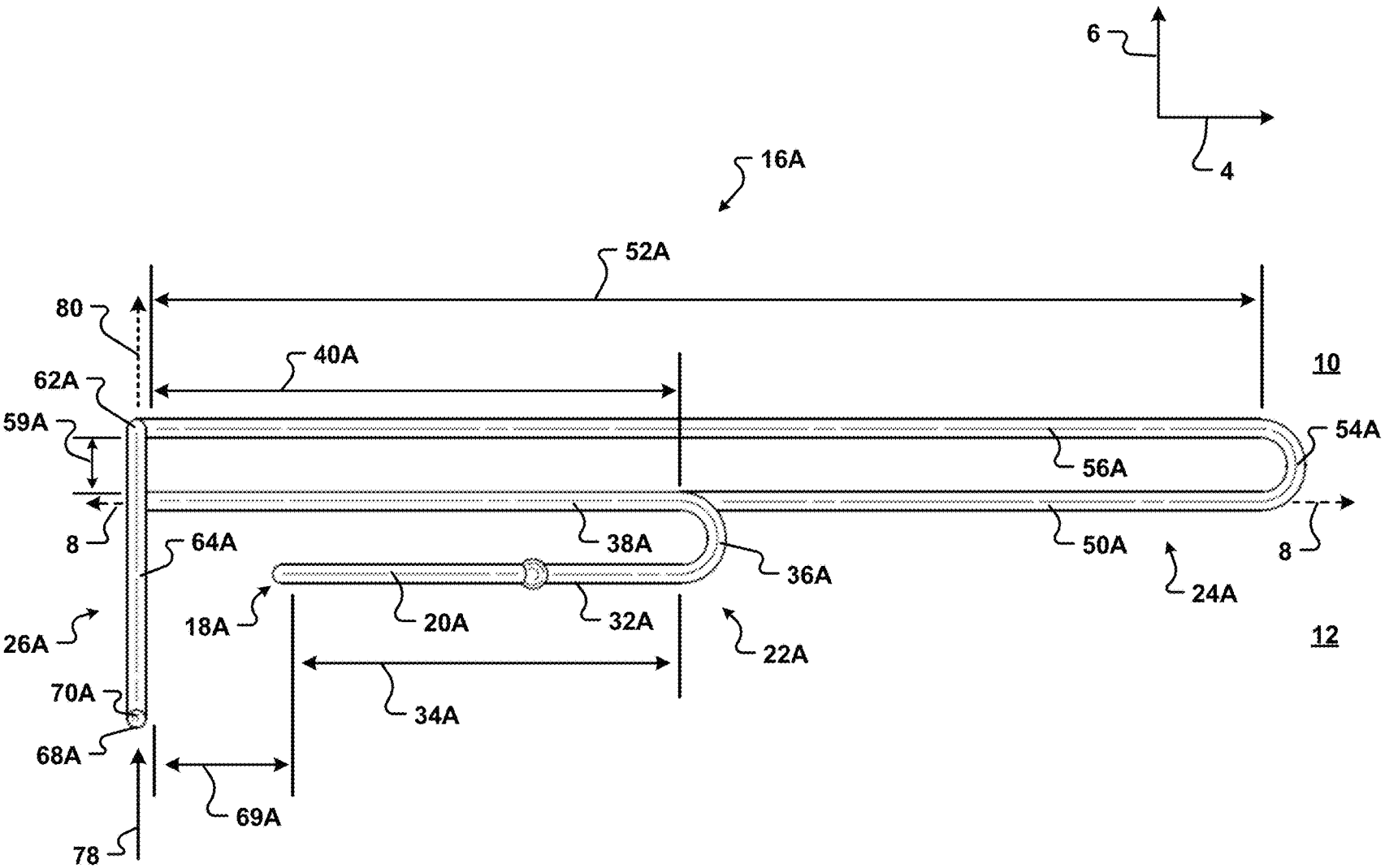
FIG. 4A is a top plan view of the pants hanger shown in FIG. 2.
Figure 4B:
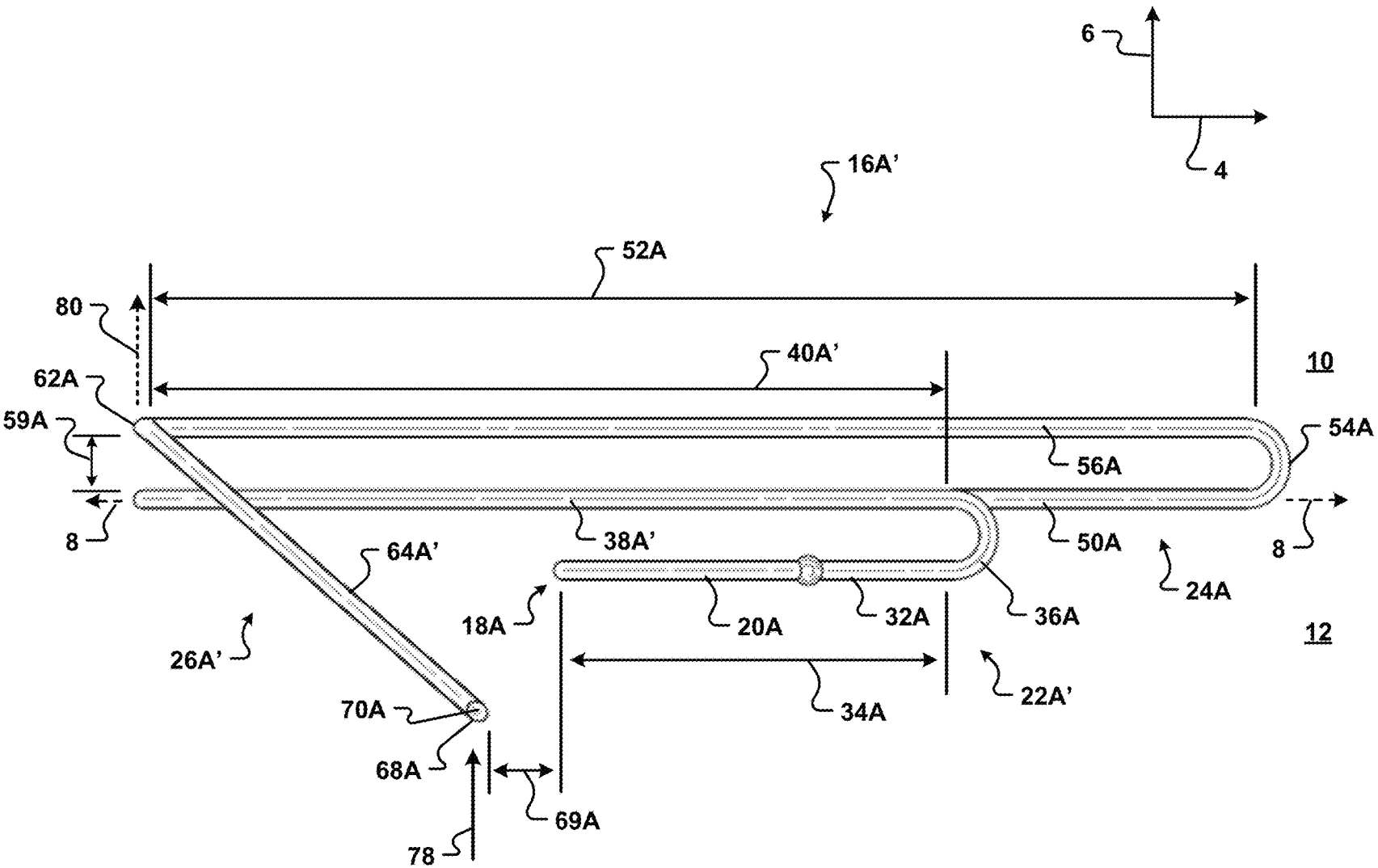
FIG. 4B is a top plan view of the pants hanger shown in FIG. 3B and illustrating another embodiment of the actuator portion.

In some embodiments, as generally illustrated in FIGS. 3B and 4B, the hook portion 18A is substantially centered on the hanger 16A'. In this manner, the hanger 16A' may hang from the support 14 with its clamp portion 24A oriented horizontally.

The hook 20A ends in a neck 28A. In one embodiment, the neck 28A is oriented generally vertically and approximately parallel to the vertical axis 2. However, in other embodiments, the neck 28A may be oriented at an oblique angle relative to the vertical axis 2.

On the opposite side of the neck 28A from the hook 20A, the hook portion 18A is connected to the handle portion 22A by a first turn 30A. In one embodiment, the first turn has an angle of between approximately 80° and approximately 100°, or approximately 90°. Accordingly, in one embodiment, the end of the first turn 30A opposite the neck 28A proceeds along the horizontal direction approximately parallel to the horizontal axis 4.

Figure 5:
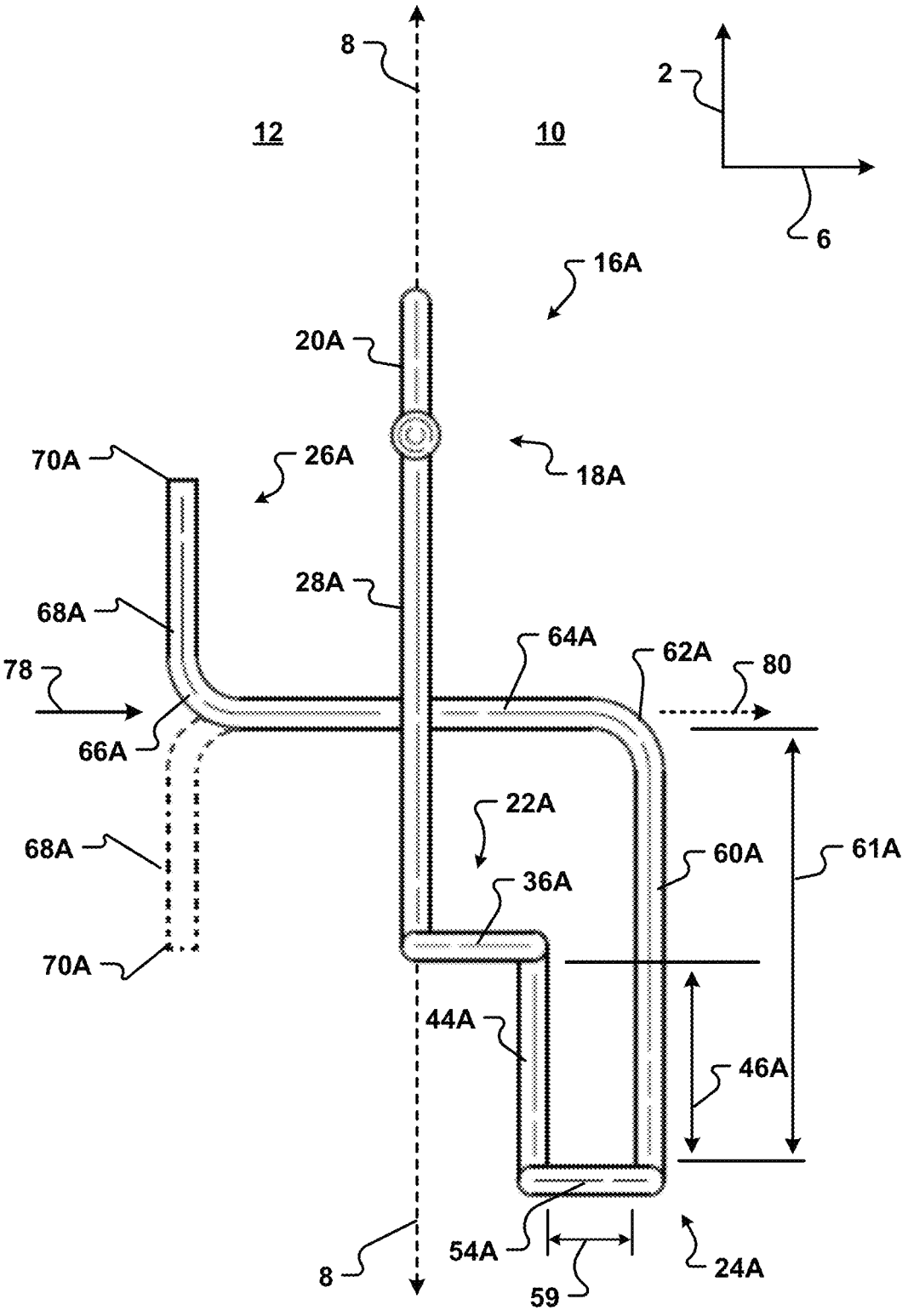
FIG. 5 is a right elevation view of the pants hanger shown in FIG. 2 and illustrating an optional configuration of a trigger of the pants hanger.

The handle portion 22A includes a first arm 32A, an upper bend 36A and a second arm 38A. In one embodiment, the first arm 32A is oriented approximately horizontally when the hanger 16A is positioned on a support 14. Optionally, the neck 28A and the first arm 32A define a vertical plane 8 as generally illustrated in FIG. 5. In some embodiments, the neck 28A is approximately orthogonal the first arm 32A.

Referring now to FIG. 3A, in one embodiment the first arm 32A is generally straight or linear. The first arm 32A has a first length 34A extending between the first turn 30A and the upper bend 36A. The first length 34A is sufficient to be grasped by the user's hand. In one embodiment, the first length is between approximately 1 inch and approximately 5 inches.

Referring again to FIG. 1A, the upper bend 36A connects the first arm 32A to the second arm 38A. The upper bend 36A may have any predetermined radius of curvature. In one embodiment, the upper bend 36A has a radius of curvature such that an end of the first arm 32A is spaced less than approximately 0.5 inch, or between approximately 0.125 inch and 0.25 inch from a beginning of the second arm 38A.

As generally shown in FIG. 5, the upper bend 36A extends to a first side 10 of the vertical plane 8 in a lateral direction defined by the lateral axis 6. In one embodiment, the upper bend extends over approximately 180 degrees. Accordingly, the first arm 32A is optionally approximately parallel to the second arm 38A. However, in another embodiment, the upper bend 36A may extend between approximately 165 degrees and approximately 195 degrees. In one embodiment, the first arm and the second arm are coplanar. Optionally, the second arm 38A is generally linear.

Referring again to FIG. 3A, the second arm 38A extends from the upper bend 36A and ends at a second turn 42A. The second arm has a predetermined second length 40A. In one embodiment, the second length is approximately equal to the first length 34A. Alternatively, the second arm 38A extends past the first turn 30A in the horizontal dimension 4. Accordingly, the second arm 38A may have a second length 40A that is greater than the first length 34A of the first arm 32A.

In another embodiment, and referring now to FIG. 3B, the second length 40A' of the second arm 38' may be selected such that the hook 20A is approximately centered along a length 52A of a first leg 50A of a clamp portion 24A of the hanger 16A'. In this manner, the weight of the hanger 16A' may be substantially evenly distributed relative to the support 14 such that the clamp portion 24A is approximately horizontal when the hanger hangs from the support.

Referring again to FIG. 1A, the second turn 42A is oriented downwardly away from the hook portion 18A in the vertical dimension 2. In one embodiment, the second turn 42A extends between approximately 80° and approximately 100°, or approximately 90°.

In one embodiment, the second turn 42A connects the second arm 38A to a spine 44A. The spine 44A is a generally vertical section that ends at a third turn 48A. In one embodiment, the spine 44A is approximately parallel to the vertical axis 2 when the hanger is positioned on a support 14, such as a closet rod. Optionally, the spine 44A is generally linear. However, the spine 44A may have any desired configuration. As generally shown in FIG. 5, in one embodiment the spine 44A is offset from the neck 28A on the first side 10 of the vertical plane 8.

The third turn 48A extends generally in the direction toward the neck 28A. More specifically, the third turn may extend over between approximately 80° and approximately 100°, or approximately 90°.

The third turn 48A connects the spine 44A to the clamp portion 24A. The clamp portion 24A is thus separated from the handle portion 22A by the spine 44A. In some embodiments, the spine 44A is oriented approximately orthogonal to a first leg 50A of the clamp portion 24A.

Referring now to FIG. 5, the spine 44A has a height 46A sufficient to allow the user to grasp the handle portion 22A without interfering with operation of the clamp portion 24A. In one embodiment, the spine 44A has a height 46A of between approximately 0.5 inch and approximately 3 inches, or about 1 inch. In this manner, the handle portion 22A is separated in the height dimension (parallel to the vertical axis 2) from the clamp portion 24A by between approximately 0.5 inch and approximately 3 inches.

The clamp portion 24A includes a first leg 50A, a lower bend 54A, and a second leg 56A. Referring again to FIGS. 3A and 3B, in some embodiments, the first leg 50A is oriented generally horizontally (or approximately parallel to the horizontal axis 4) when the hanger is positioned on a support 14, such as a closet rod. Optionally, the first leg 50A is generally linear.

Alternatively, the first leg 50A may have a bend. More specifically, in one embodiment, the first leg 50A has a bend or a curve the same as (or similar to) the bend 57 of the second leg 56A" described in conjunction with FIGS. 1B and 4C.

The first leg 50A has a length 52A that extends between the third turn 48A and the lower bend 54A. The length 52A optionally is greater than the first length 34A and the second length 40A of the first and second arms, respectively. In one embodiment, the first leg 50A is approximately parallel to at least one of the first arm 32A and the second arm 38A. Additionally, or alternatively, the neck 28A is optionally approximately perpendicular to the first leg 50A.

The first leg 50A may have any desired length 52A. In some embodiments the length 52A is between approximately 5 inches and approximately 10 inches, or about 7 inches.

The lower bend 54A connects the first leg 50A to the second leg 56A. The first and second legs 50A, 56A may be approximately co-planar. Optionally, the second leg 56A is generally linear.

The lower bend 54A may have any predetermined radius of curvature. In one embodiment, the lower bend 54A has a radius of curvature such that an end of the first leg 50A is spaced less than approximately 0.5 inch, or between approximately 0.125 inch and 0.25 inch from a beginning of the second leg 56A.

In one embodiment, the lower bend 54A provides a spring force to bias the first leg 50A and second leg 56A toward each other into the closed position. The lower bend 54A biases the first and second legs 50A, 56A into a predetermined orientation that defines a closed position of the clamp portion 24A, such as generally illustrated in FIGS. 1A-5. When the clamp portion is in the closed position the first leg 50A is proximate to the second leg 56A to clamp a pair of pants therebetween.

In one embodiment, the lower bend 54A extends from between about 160° to about 200°, or about 180°. Accordingly, the first leg 50A and second leg 56A are optionally approximately parallel as generally illustrated in FIGS. 4A and 4B. However, in another embodiment, at least a portion of the second leg 56A is oriented at an acute angle relative to the first leg 50A.

Figure 4C:
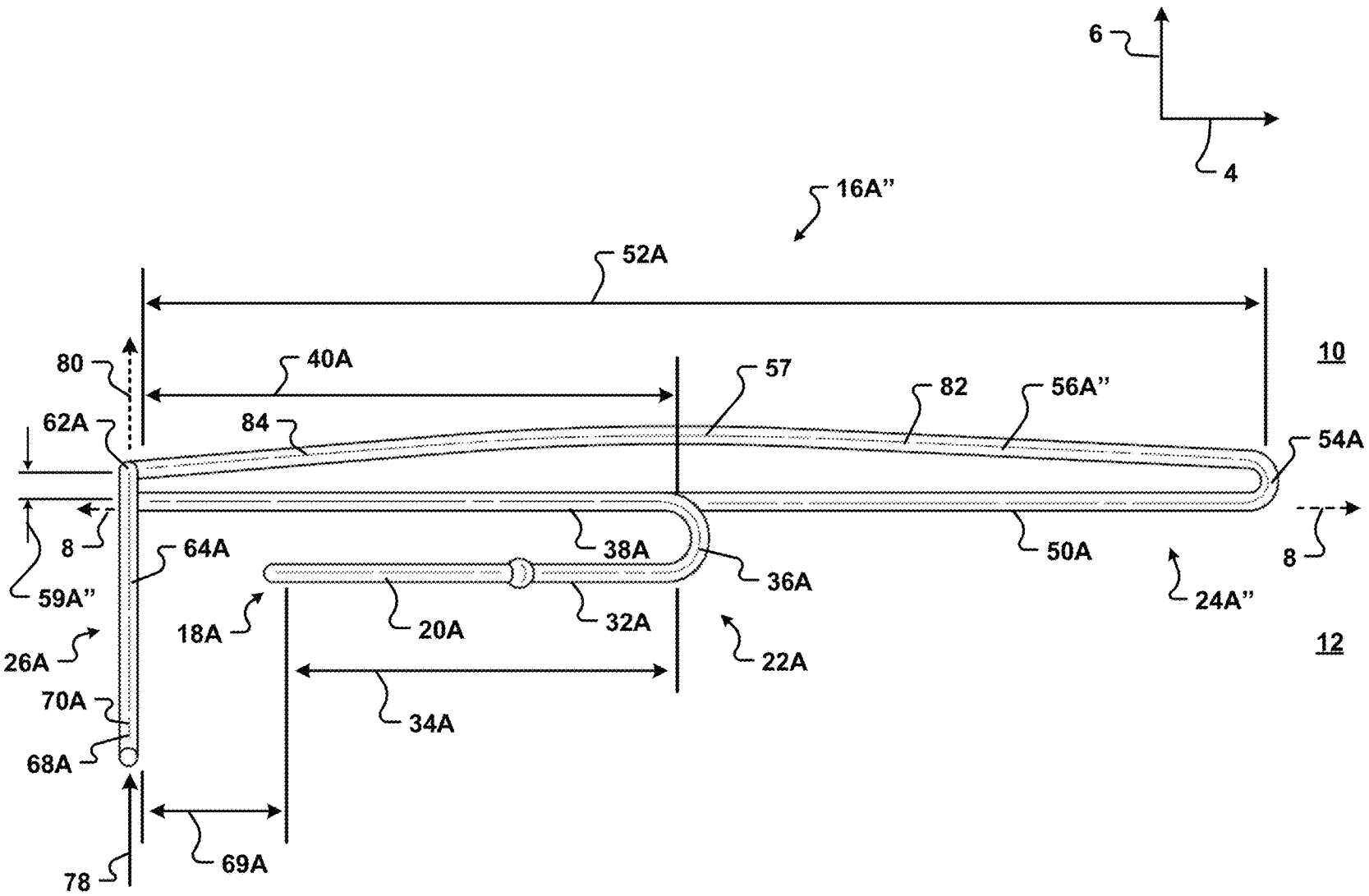
FIG. 4C is a top plan view of the pants hanger of FIG. 1B and illustrating one embodiment of a curved leg.

More specifically, and referring now to FIG. 4C, in one embodiment, the second leg 56A" is not linear. Optionally, the second leg 56A" includes a curve or a bend 57. In one embodiment, the bend 57 is positioned proximate to a center or medial portion of the second leg 56A".

In this manner, a first portion 82 of the second leg 56A" between the lower bend 54A and the leg bend 57 is angled away from the first leg 50A. In one embodiment, the lower bend 54A extends between approximately 176° and approximately 180°. Accordingly, the first portion 82 of the second leg may be oriented at an acute angle to the first leg 50A. In one embodiment, the acute angle between the first portion 82 of the second leg and the first leg 50A is between about 1° and about 4°, or between about 2° and about 3°. In this manner, the first and second legs 50A, 56A define a locking taper configured to clamp a pair of pants in the clamp portion 24A of the hanger.

A second portion 84 of the second leg 56A" between the leg bend 57 and the fourth turn 58A may be angled toward the first leg 50A. Accordingly, in one embodiment, the distance between the second portion 84 of the second leg and the first leg 50A decreases as the second leg extends from the leg bend 57 toward the fourth turn 58A. In one embodiment, the second portion 84 of the second leg and the first leg 50A are oriented at an acute angle of between about 1° and about 4°, or between about 2° and about 3°.

Additionally, or alternatively, in one embodiment the first leg 50A is not linear. For example, the first leg 50A may have a bend 57 the same as, or similar to, the bend 57 of the second leg 56A".

Figure 2:
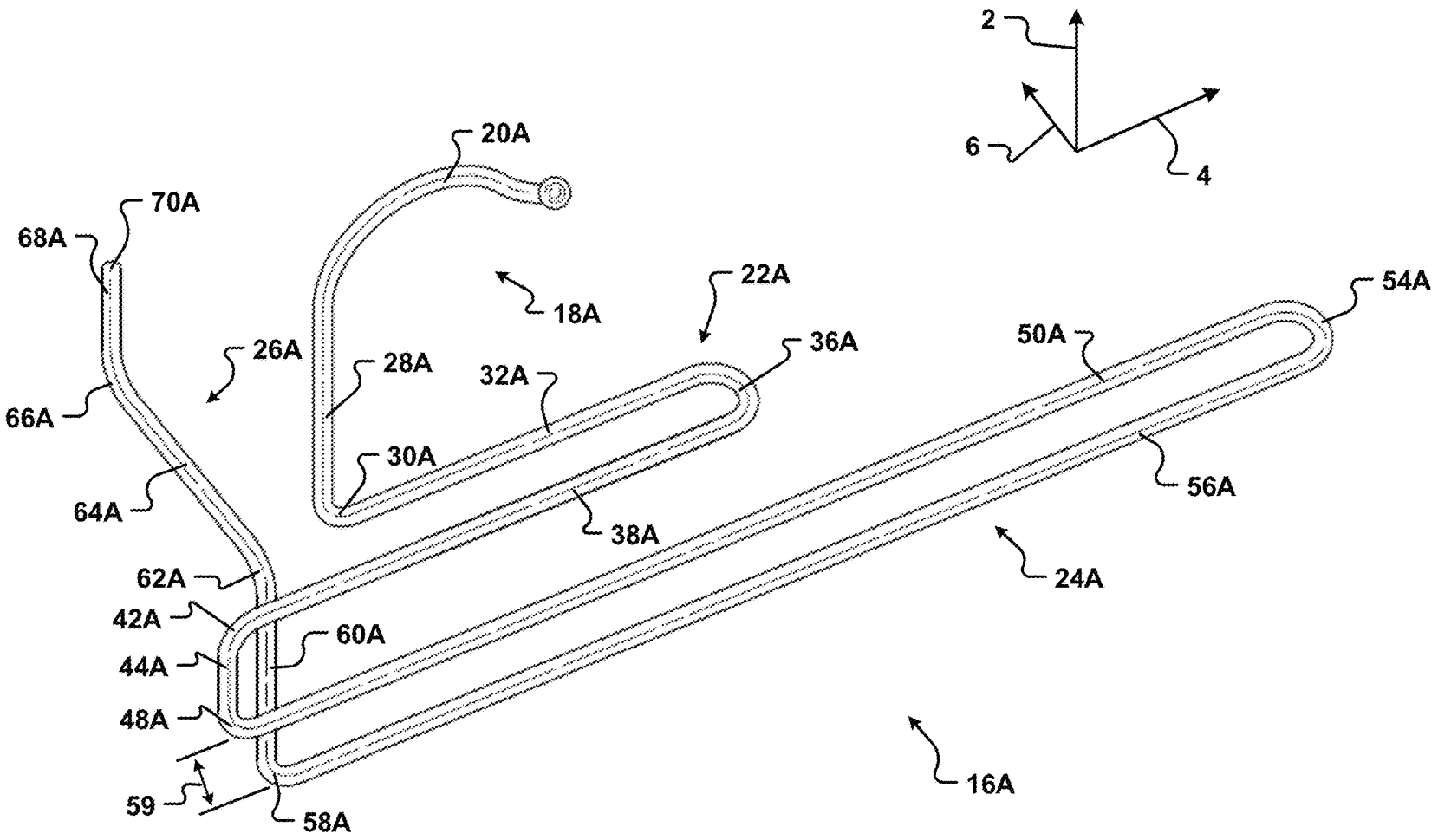
FIG. 2 is a bottom perspective view of the pants hanger of FIG. 1A with the padding removed for clarity.

The second leg 56A ends at a fourth turn 58A. The fourth turn 58A is a first distance 59 from the third turn 48A when the clamp is in the closed position as generally illustrated in FIG. 2. In one embodiment, the first distance 59 is less than approximately 0.5 inch, or between approximately 0.125 inch and 0.25 inch.

The distance 59 may vary based on the configuration of the first and second legs 50A, 56A. For example, in one embodiment, a hanger 16A with legs 50A, 56A that are generally linear may have first distance 59A between the third and fourth turns 48A, 58A as generally illustrated in FIGS. 4A and 4B. In another embodiment, a hanger 16A" with at least one leg 50A, 56A" that is not linear may have a second distance 59A" between the third and fourth turns as generally illustrated in FIG. 4C. In one embodiment, the distance 59A is greater than the distance 59A".

In one embodiment, the fourth turn 58A is approximately parallel with the third turn 48A. Accordingly, the length of the second leg 56A may be approximately equal to the length 52A of the first leg 50A. However, the second leg 56A may be longer or shorter than the first leg 50A.

Referring again to FIG. 1A, the fourth turn 58A connects the clamp portion 24A to the actuator portion 26A. In one embodiment, the fourth turn 58A extends between approximately 80° and approximately 100°, or approximately 90°.

The actuator portion 26A generally includes a post 60A, a spar 64A, and a trigger 68A. The post 60A is connected to the fourth turn 58A and extends to a fifth turn 62A. In one embodiment, the post 60A is generally linear. Optionally, the post 60A is oriented approximately vertically when the hanger 16A is positioned on a support 14, such as a closet rod or a hood on a wall or a door. For example, the post 60A may be approximately parallel to the vertical axis 2 when the hanger is in a position of use. Optionally, the post 60A is approximately parallel to one or more of the neck 28A and the spine 44A.

Referring now to FIGS. 3A and 4A, in one embodiment, the second leg 56A extends past the neck 28A in the horizontal dimension 4 a predetermined distance. In this manner, the actuator portion 26A and the post 60A are spaced a predetermined distance 69A from the handle portion 22A. In one embodiment, the distance 69A is less than approximately 1.5 inches, or between approximately 0.5 inch and 0.75 inch. This is beneficial because a user grasping the handle portion 22A can then reach the trigger 68A with their thumb (or another finger) to apply a force to the trigger to move the clamp portion 24A into an open position to receive a pair of pants.

Referring again to FIG. 5, the post 60A has a predetermined height 61A extending between the fourth and fifth turns. The post height 61A is generally greater than the height 46A of the spine 44A. In this manner, the trigger 68A is generally positioned above the handle portion 22A in the vertical dimension when the hanger is positioned on a support 14. This beneficially prevents the trigger 68A from interfering with alignment of a pair of pants with the clamp portion 24A. Optionally, the post height 61A is between approximately 0.75 inches and about 4 inches.

The fifth turn 62A connects the post 60A to the spar 64A. In some embodiments, the fifth turn 62A extends from approximately 80° to approximately 100°, or approximately 90°.

The spar 64A may run along the lateral direction 6 such that it crosses from the first side 10 of the vertical plane 8 to a second side 12 of the vertical plane. In one embodiment, the spar 64A extends over the spine 44A as generally illustrated in FIG. 3A. The spar 64A may be generally linear. In one embodiment, the spar 64A is approximately perpendicular to the vertical plane 8 and the first and second arms 32A, 38A. However, the spar 64A may have any desire geometry relative to the post 60A in order to position the trigger 68A no more than a predetermined distance 69A from the handle portion 22A.

For example, and referring now to FIGS. 3B and 4B, in some embodiments the spar 64A' may extend at an oblique angle relative to the second leg 56A. In this manner, the spar 64A' can position the trigger 68A proximate to the handle portion 22A.

The spar 64A extends to a sixth turn 66A which connects the spar 64A to the trigger 68A. The sixth turn 66A optionally extends from approximately 80° to approximately 100°, or approximately 90°. However, the sixth turn 66A may have any desired angular extend to position the trigger 68A proximate to the handle portion 22A.

The trigger 68A extends from the spar 64A on the second side 12 of the vertical plane. Optionally, the trigger is generally linear. In one embodiment, the trigger 68A ends in a free end 70A. The trigger 68A may optionally extend upwardly from the sixth turn 66A such that the free end 70A is above the sixth turn when the hanger is suspended from a support 14 as illustrated in FIG. 3A. However, as will be appreciated by one of skill in the art, the trigger may have different configurations and orientations. Alternatively, the trigger 68A optionally extends downwardly from the sixth turn 66A as generally illustrated in FIG. 5. In one embodiment, the trigger 68A extends from the sixth turn 66A in the horizontal dimension 4. For example, the trigger 68A may extend in the horizontal dimension toward the handle portion.

In at least one embodiment, the hanger 16A is configured to be held by the user's right hand. However, the hanger of the present disclosure may be configured to be held by a user's left hand.

To use the hanger 16A, the user holds the hanger 16A by the handle portion 22A with their right hand. The user then presses their right thumb against the trigger 68A to apply a force 78 to the trigger in the lateral direction 6 as generally illustrated in FIGS. 4A, 4B, 4C. The trigger transfers the force to the lower bend 54A. As the user presses the trigger 68A, the trigger moves toward the vertical plane 8 and a portion of the second leg 56A bends away from the vertical plane 8 as indicated by arrow 80 to place the clamp portion 24A in an open position. The lower bend 54A is then forced open such that the first leg 50A and second leg 56A are not parallel. In this manner, at least a portion of the second leg 56A moves away from the first leg 50A to move the clamp portion 24A to the open position. In the open position, the distance 59 between the third turn and the fourth turn increases.

The user then inserts the end of the leg of the pants into the space or gap created between the first leg 50A and the second leg 56A. The user then releases the trigger 68A. The lower bend 54A is biased such that at least a portion of the second leg 56A moves back towards the first leg 50A and the clamp portion 24A returns to its original, closed position when the force from the user is released. In the closed position the pants legs are clamped between the legs such that the pants are supported against the pull of gravity.

In some embodiments there is a padding 74 that coats or covers portions of the hanger 16A. Preferably, the padding covers at least a portion of the clamp portion 24A and the actuator portion 26A. The padding 74 optionally covers some or all of the handle portion 22A. In one embodiment, one or more of the first and second arms 32A, 32B are at least partially covered with the padding 74.

In some embodiments the padding 74 is a foam material. The padding 74 may also be a rubber material, a plastic material, or other similar soft material. The padding 74 may serve to provide an additional clamping force and increase frictional resistance to the gravitational forces acting on the pants.

Additionally, or alternatively, portions of the hanger 16A may have a textured surface. For example, any portion of the hanger 16A may include knurling. In some embodiments, the textured surface may include protrusions, such as dimples or bumps. The textured surface may be configured to increase friction to a pair of pants in the clamp portion 24 or to facilitate grasping of the handle portion 22A by a user. Any textured surface may be used with the hangers 16 of the any embodiment of the present disclosure.

In one embodiment, the first arm 32A and second arm 38A are located approximately parallel to each other in a horizontal plane. Additionally, or alternatively, the second arm 38A and the first leg 50A may be located approximately parallel to each other in a vertical plane 8. Optionally, the first leg 50A and second leg 56A are approximately parallel. In one embodiment, the first and second legs are located in a horizontal plane. In one embodiment, one or more of the trigger 68A, the post 60A, the spine 44A, and the neck 28A are approximately parallel to the vertical axis 2. In another embodiment, the upper bend 36A defines a first angle that is approximately equal to a second angle of the lower bend 54A.

The hanger 16A is optionally made from a single piece of metal that has been extruded into a wire. The wire is then bent into the desired configuration. While the hanger is preferably a single piece of metal, other configurations are contemplated such as plastic or other composite materials.

The hanger 16A is optionally formed of a metal wire with a predetermined gauge. In one embodiment, the metal wire has a diameter of between approximately 12 gauge and approximately 16 gauge, or approximately 14 gauge.

The metal wire may have a predetermined hardness or temper. In one embodiment, the wire has a "half-hard" temper.

Figure 6:
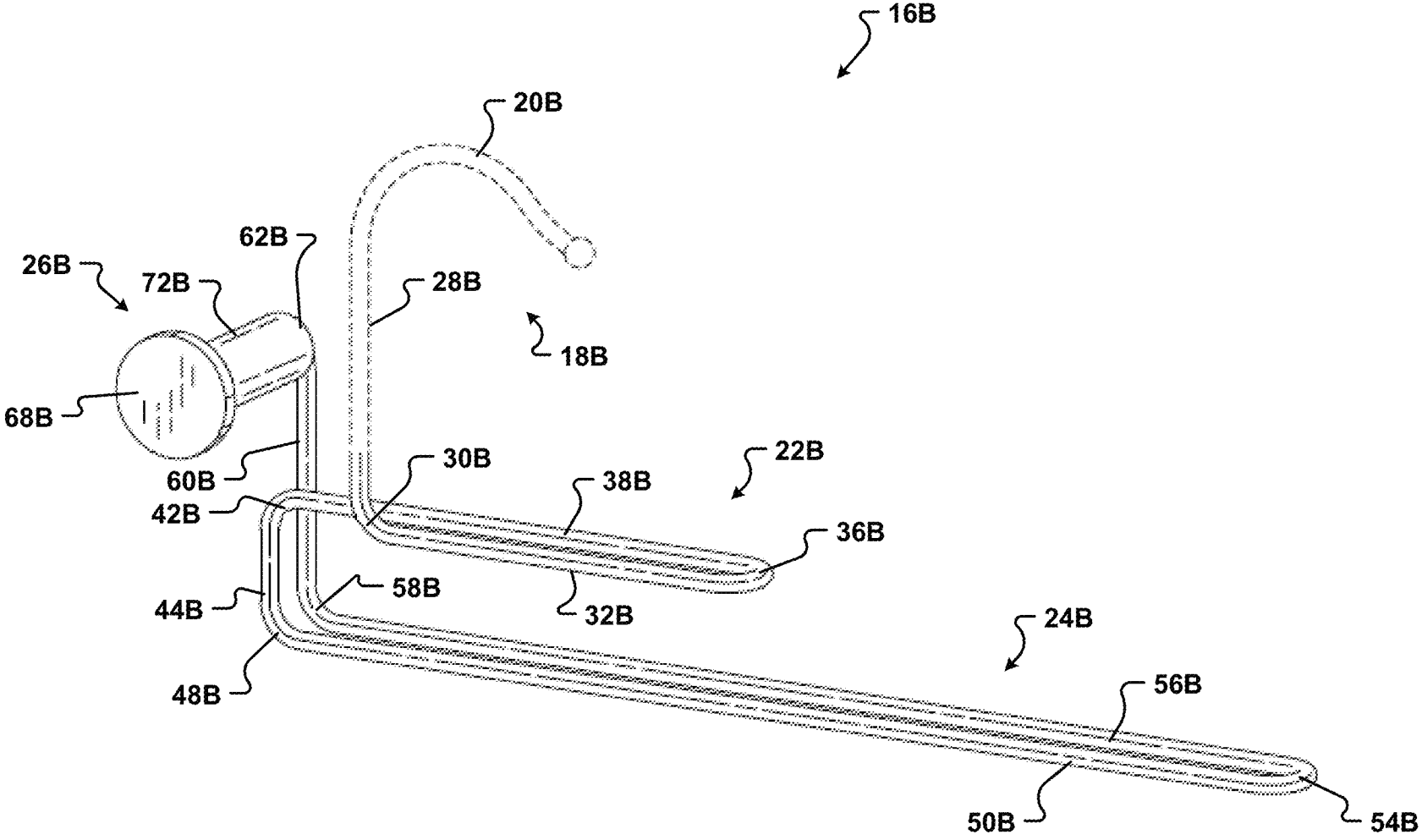
FIG. 6 is a perspective view of another embodiment of a pants hanger having a button like trigger and showing a clamp portion of the pants hanger in a closed position.
Figure 7:
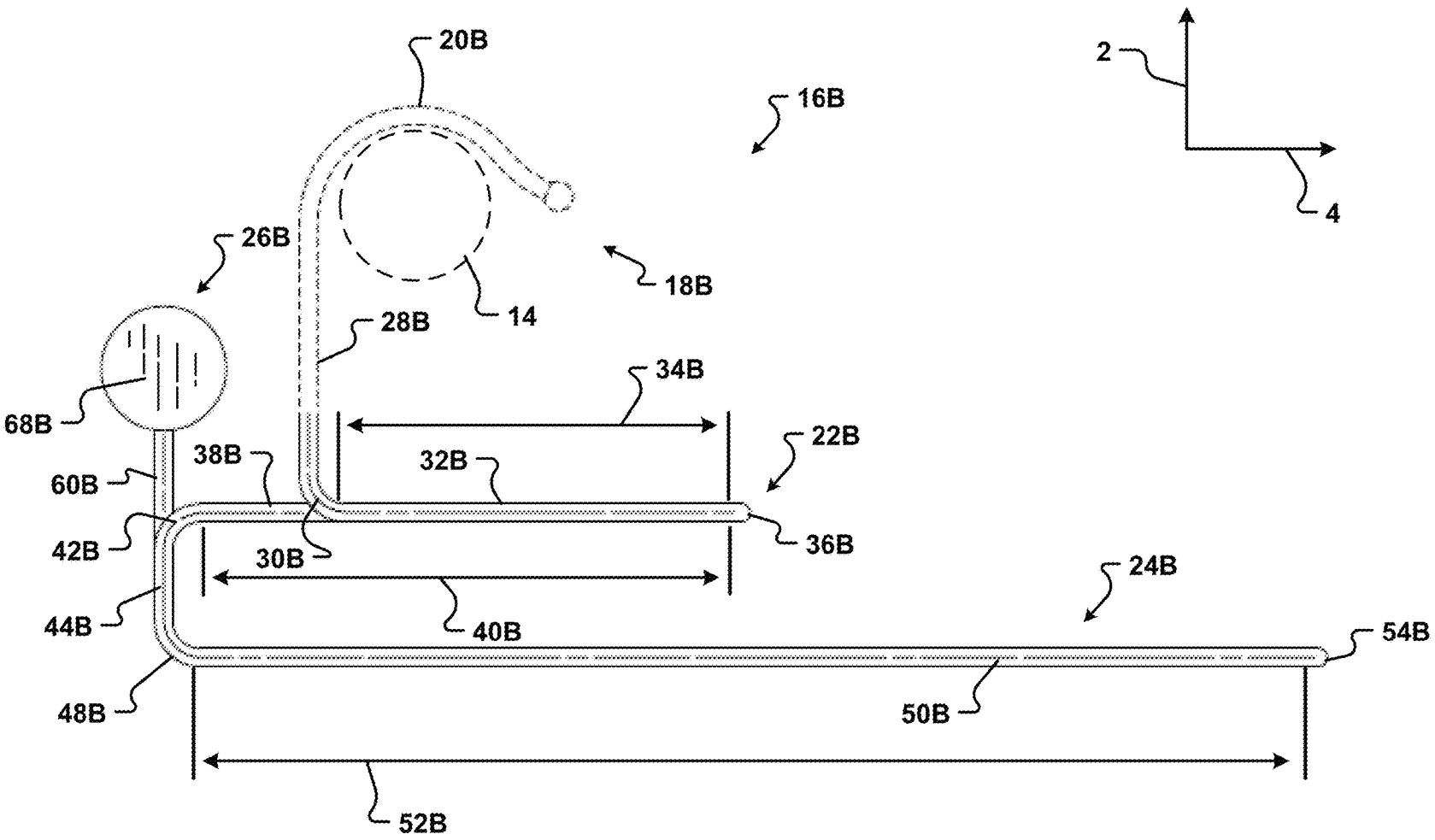
FIG. 7 is a front elevation view of the pants hanger shown in FIG. 6.
Figure 8:
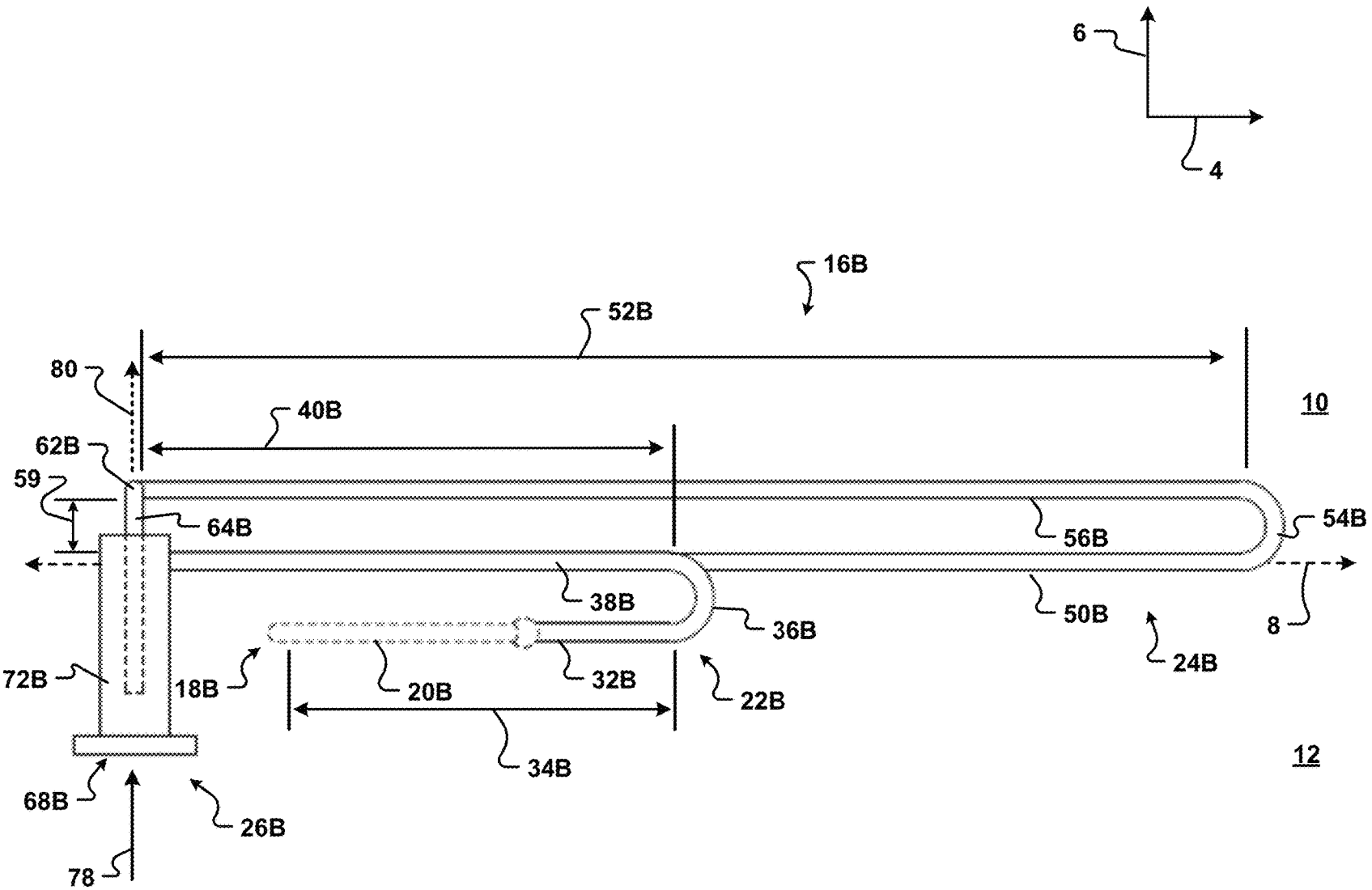
FIG. 8 is a top plan view of the pants hanger shown in FIG. 6.
Figure 9:
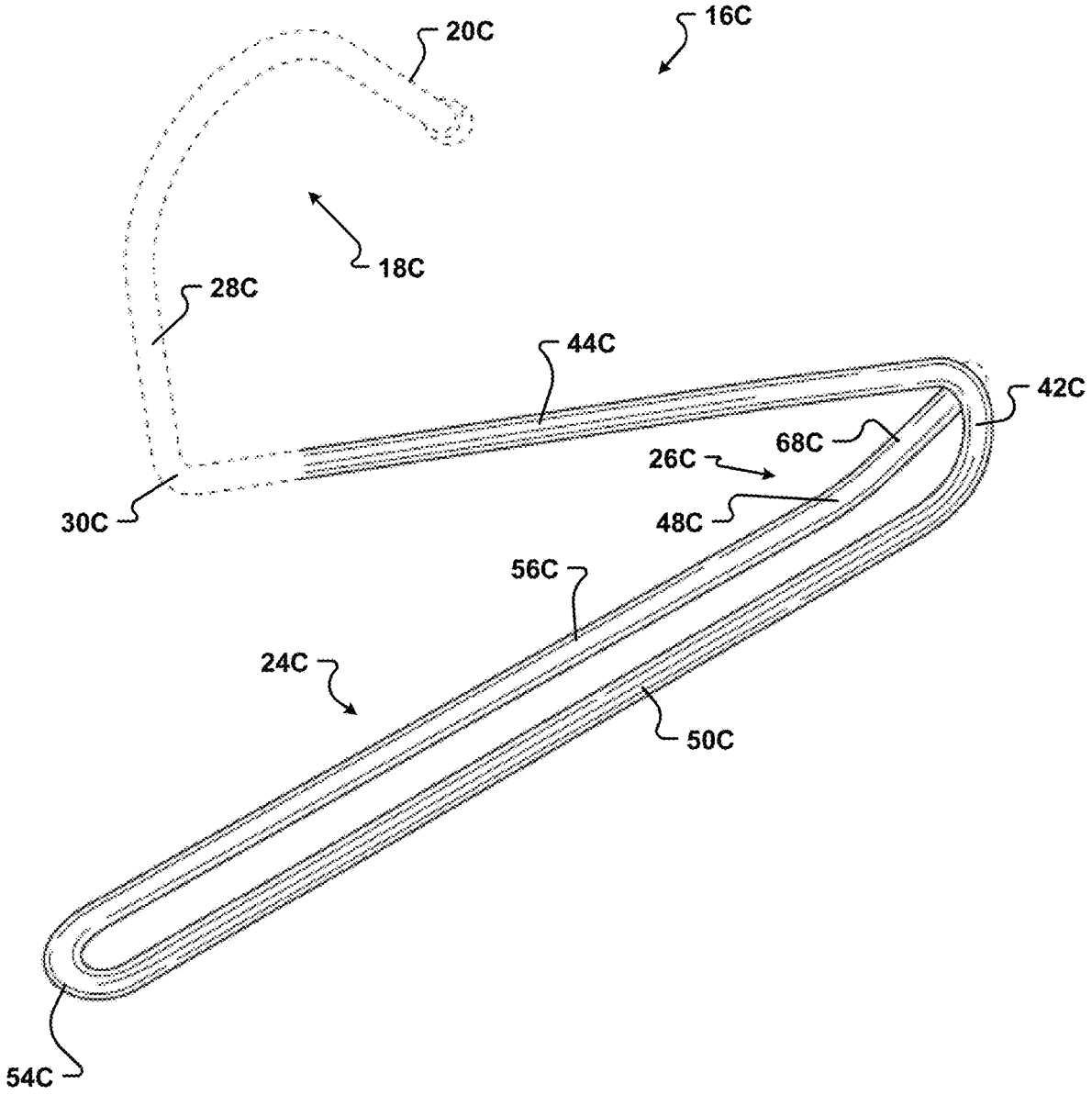
FIG. 9 is a perspective view of another embodiment of a pants hanger.

FIGS. 6-8 show another embodiment of a hanger 16B of the present disclosure. In this embodiment, hanger 16B has a hook portion 18B, a handle portion 22B, and a clamp portion 24B, that are the same as, or similar to, the hook, handle, and clamp portions of the hanger 16A described in conjunction with FIGS. 1-5. The dimensions of the hanger 16B may be the same as those illustrated and described for hanger 16A. Although not illustrated for clarity, the hanger 16B may include padding 74 similar to the hanger 16A illustrated in FIG. 1.

Notably, the hanger 16B includes an actuator portion 26B with a trigger 68B of another embodiment of the present disclosure. The trigger 68B is a separate piece of material that is attached to the spar 64B. In this embodiment, the trigger 68B has a button like surface which is wider than the spar 64B.

In some embodiments, the trigger 68B has a shaft 72B which is hollow and is able to be inserted onto the end of the spar 64B as generally illustrated in FIG. 8. The trigger may be comprised of plastic, metal, wood, composite, rubber, or other suitable material.

The hanger 16B is operated similar to the hanger 16A described in conjunction with FIG. 1. In one embodiment, the user holds the handle portion 22B with their right hand and places their right thumb on the trigger 68B. The user holds the end of pants legs in their left hand. The user then presses the trigger with their thumb to apply a force in the lateral direction as indicated by arrow 78. In response to the force, the clamp portion 24B of the hanger 16B moves from the closed position to an open position (not illustrated). The user then inserts the pants into the gap of the clamp portion 24B and then releases the trigger 68B of the actuator portion 26B. The lower bend 54B is biased to move at least a portion of the second leg toward the first leg to return the clamp portion 24B to the closed position. The clamp portion 24B then closes on the pant legs and the user may fold the pants over the second leg 56B of the clamp portion 24B.

Although not illustrated, the hanger 16B may include a leg bend 57 (such as illustrated in FIG. 4C) in one or more of the first and second legs 50B and 56B. Further the hook portion 18B may be formed such that it is generally centered above the length of the first leg 50B in a manner similar to the hanger 16A illustrated in FIGS. 3B and 4B. Moreover, the actuator portion 26B may have a different orientation and geometry, similar to those shown in FIGS. 3B an 4B.

FIGS. 9-12 show another embodiment of a hanger 16C of the present disclosure. In this embodiment, the hanger 16C has a hook portion 18C, a clamp portion 24C, and an actuator portion 26C.

The hook portion 18C includes a hook 20C having a free end and being configured to engage a support 14. The hook 20C may be formed at a position that is substantially centered along a length of the clamp portion 24C. In this manner, the clamp portion 24C may be approximately horizontal when the hook is hanging from the support 14.

The opposite side of the hook 20C transitions into the neck 28C. The neck 28C extends to a first turn 30C that connects to an upper end of a spine 44C. The spine 44C may be generally linear. A lower end of the spine 44C ends in a second turn 42C. The second turn 42C connects the clamp portion 24C to the hook portion 18C.

The clamp portion 24C begins at the second turn 42C which transitions into a first leg 50C. The first leg 50C extends to a lower bend 54C. A second leg 56C extends from the lower bend 54C.

The first and second legs 50C, 56C are the same as or similar to the legs of the hanger described in conjunction with FIGS. 1-5. For example, in one embodiment, one or more of the first and second legs 50C, 56C are generally linear. Optionally, the first and second legs define a plane that is oriented approximately horizontally when the hanger 16C is positioned on the support 14.

Although not illustrated, the hanger 16C optionally includes a leg bend 57 (such as illustrated in FIG. 4C) in one or more of the first and second legs 50C and 56C.

The lower bend 54C may also be the same as or similar to the lower bend 54A of hanger 16A. More specifically, the lower bend 54C extends over an angle of between approximately 170° and approximately 200°. In one embodiment, the lower bend 54C defines an angle of greater than 180 degrees such that the second leg 56C is angled towards the first leg 50C. More specifically, a distance between the second leg and the first leg decreases as the second leg extends from the lower bend 54C. In one embodiment, the second leg is angled toward the first leg at an acute angle of between about 1° and about 4°.

Figure 12:
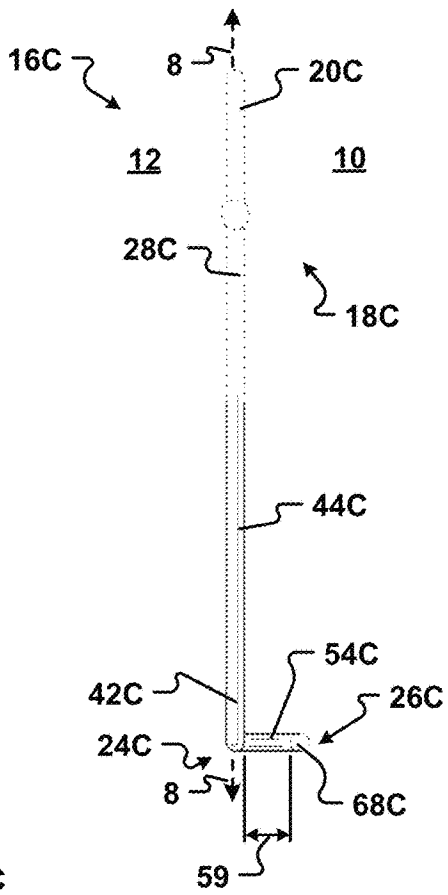
FIG. 12 is a right elevation view of the hanger shown in FIG. 9.
Figure 10:
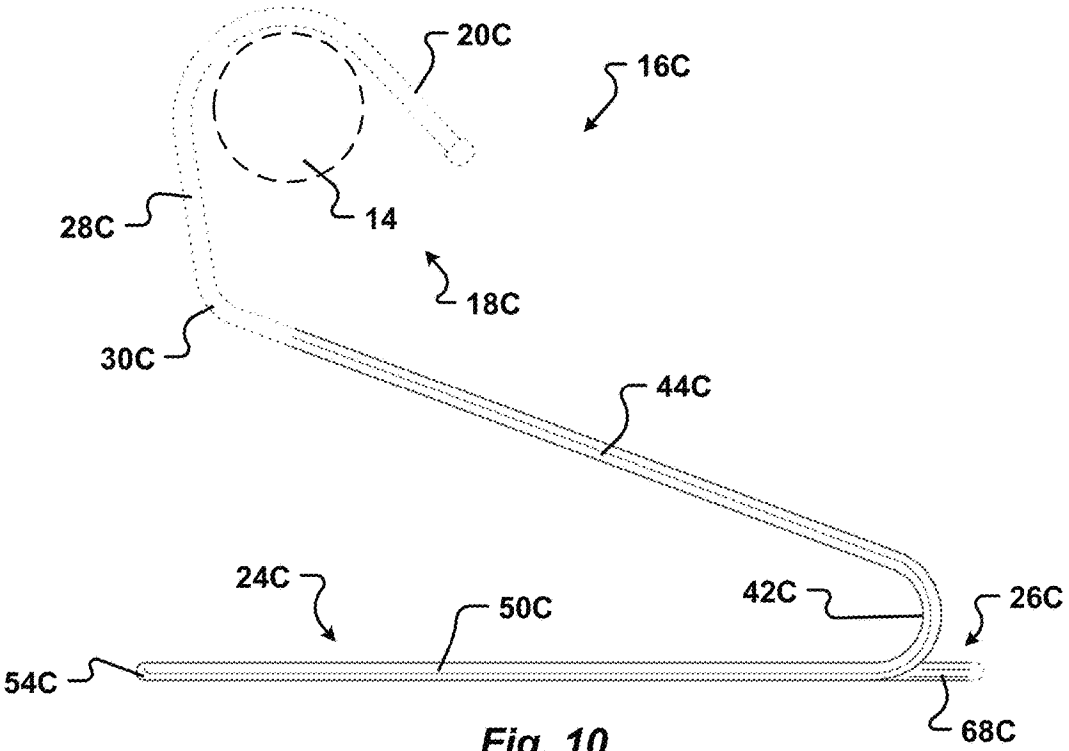
FIG. 10 is a front elevation view of the hanger shown in FIG. 9.

Similar to the lower bend of hanger 16A, the lower bend 54C biases the first and second legs into a closed position. As generally illustrated in FIG. 12, when the clamp portion 24C is in the closed position, the second leg 56C is a predetermined distance 59 from a second turn 42C of the hanger.

Figure 11:
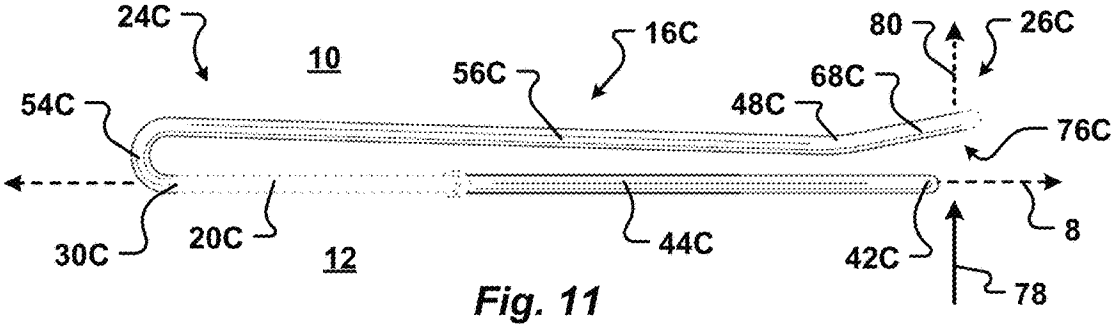
FIG. 11 is a top plan view of the hanger shown in FIG. 9.
Figure 13:
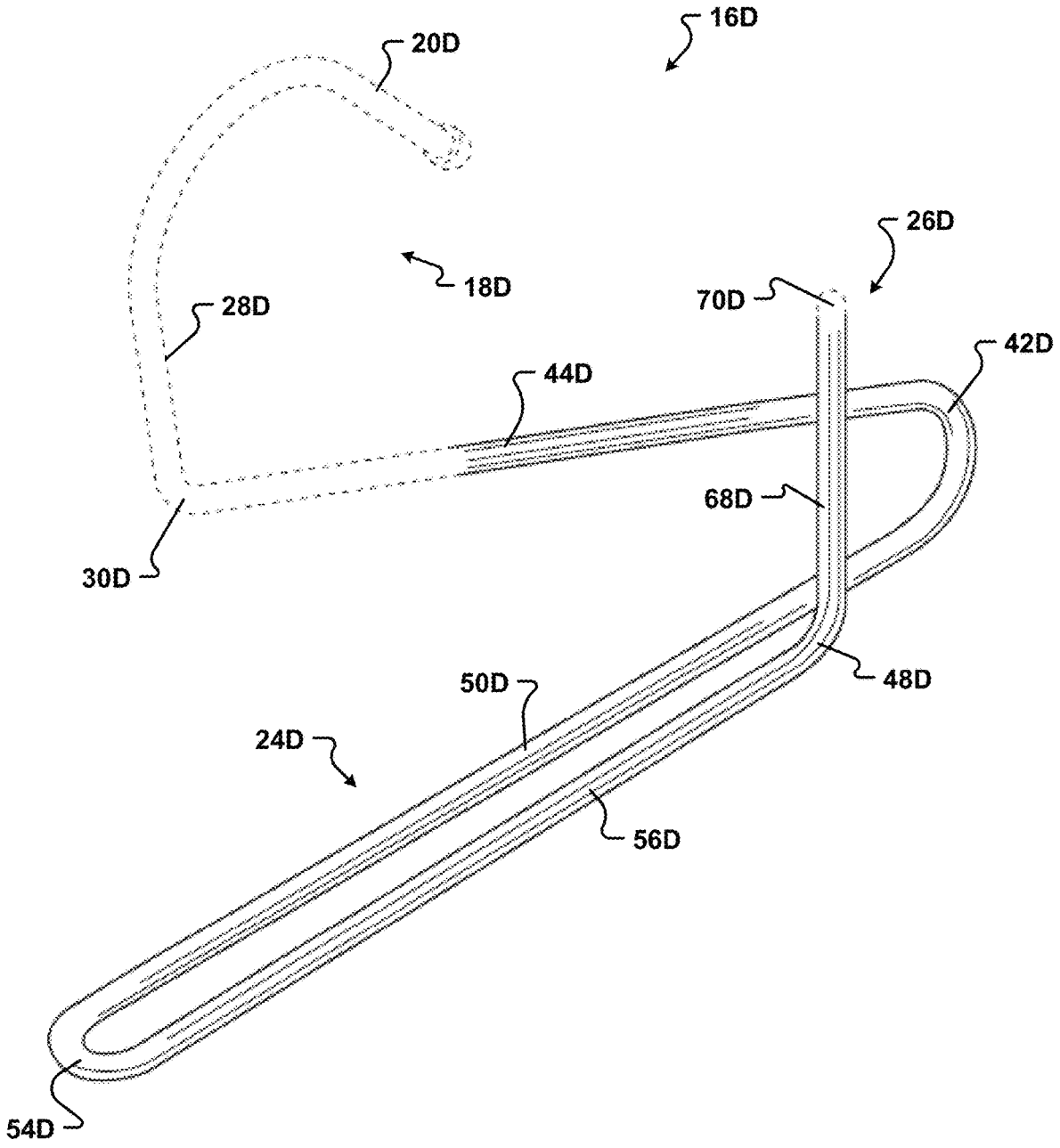
FIG. 13 is a perspective view of another embodiment of a pants hanger.

The second leg 56C extends to a third turn 48C which connects the clamp portion 24C to the trigger 68C. The third turn 48C is angled such that the trigger 68C is oriented away from the first leg 50C. Referring to FIG. 11, the third turn 48C may direct the trigger away from a vertical plane 8 defined by the spine 44C and the first leg 50C. Accordingly, the trigger 68C may extend away from the vertical plane 8. In this manner, the trigger 68C defines a guide 76C to help position the pants within the clamp portion 24C.

To move the clamp portion 24C to an open position, the user applies a force 78 to the trigger 68C. The second leg 56C and trigger 68C then move in the direction of arrow 80. This increases the distance 59 between the second leg 56C and the second turn 42C.

In this embodiment, the user holds the hanger 16C and slides the pants between the trigger 68C and the second turn 42C. The pants can then be folded over the second leg 56C. As the trigger 68C is angled away from the second leg 56C, the trigger guides the pants into the clamp portion 24C as they are being inserted between the clamp legs. This method of use prevents the user from having to thread the pants leg through the opening of a traditional hanger.

While not shown in FIGS. 9-12, optionally, at least a portion of one or more of the first leg 50C and the second leg 56C may be covered with padding 74 as shown in FIG. 1. In this embodiment, the user presses the trigger 68C to open the gap between the first leg 50C and the second leg 56C. The user then slides the pants between the first leg 50C and second leg 56C and then releases the trigger 68C. The legs then return to their original position and the padding 74 causes the legs to clamp on the pants.

FIGS. 13-16 show a different embodiment of the hanger 16D. The hanger 16D comprises a hook portion 18D, a clamp portion 24D, and an actuator portion 26D. The hook portion begins with a hook 20D, having a free end and being configured to engage a support 14, such as a hook or a closet rod. The hook 20D is optionally formed on the hanger such that the hook is substantially centered along a length of the clamp portion 24D. This is beneficial for the clamp portion 24D to be approximately horizontal when the hook is hanging from a support 14.

The hook 20D ends with a neck 28D. The neck 28D is generally vertical and ends in a first turn 30D. The first turn 30D transitions into a spine 44D. The spine 44D leads to a second turn 42D which connects the hook portion 18D to the clamp portion 24D.

The clamp portion 24D has two legs, a first leg 50D and a second leg 56D. The first leg 50D begins at the second turn 42D and ends at a lower bend 54D. The second leg extends from the lower bend. Optionally, the first and second legs are coplanar.

In one embodiment, the lower bend 54D is approximately 180 degrees. Optionally, the lower bend is greater than 180 degrees such that the second leg 56D extends toward the first leg 50D. In one embodiment, the second leg is angled toward the first leg at an acute angle of between about 1° and about 4°.

Optionally, the first and second legs are generally linear. Additionally, or alternatively, although not illustrated, the hanger 16D optionally includes a leg bend 57 (such as illustrated in FIG. 4C) in one or more of the first and second legs 50C and 56C.

Figure 16:
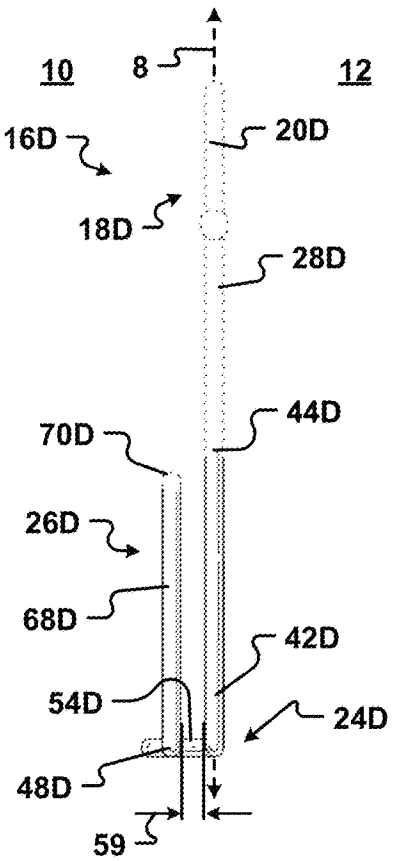
FIG. 16 is a right elevation view of the pants hanger shown in FIG. 13.
Figure 14:
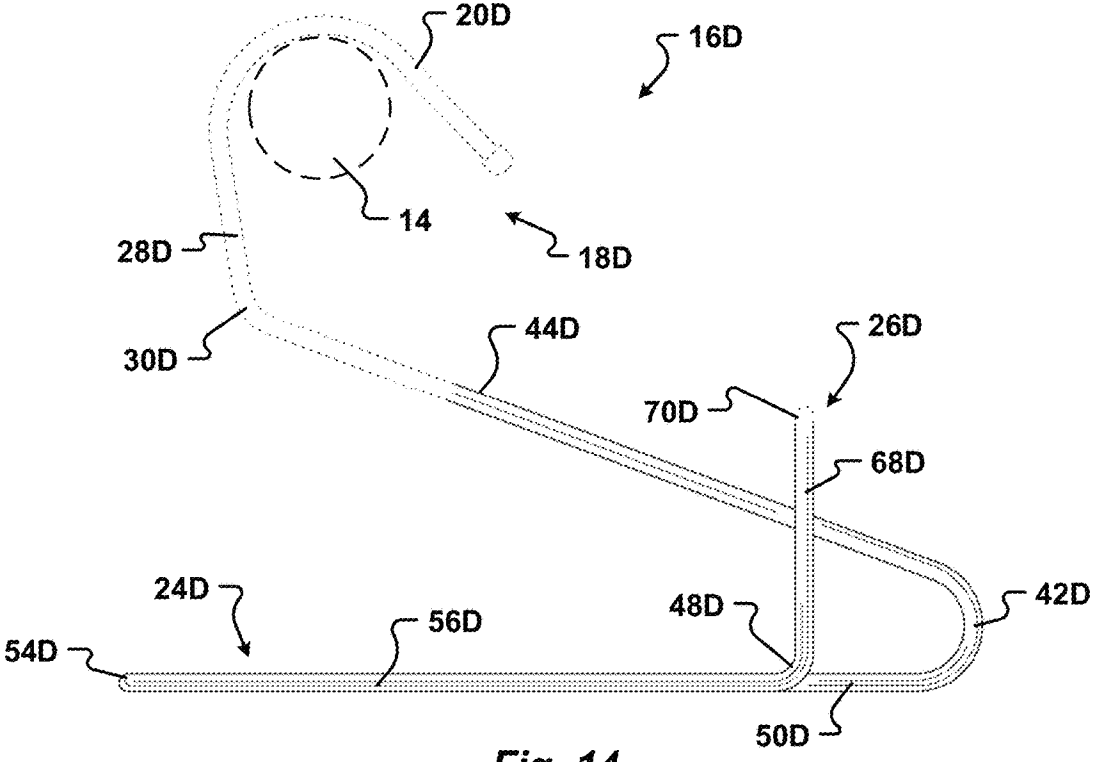
FIG. 14 is a front elevation view of the pants hanger shown in FIG. 13.
Figure 15:
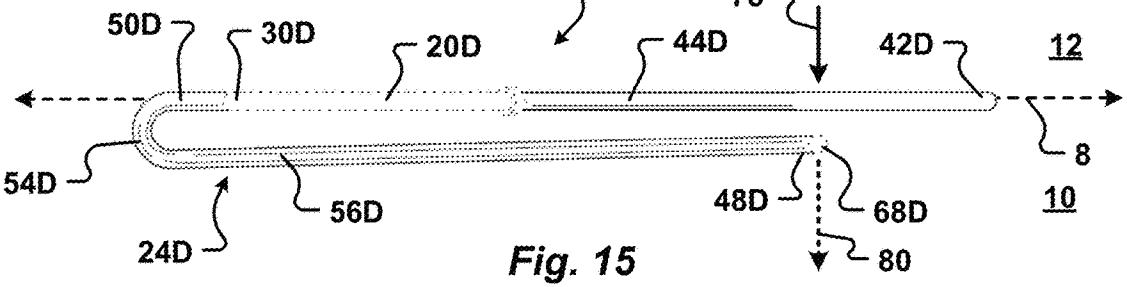
FIG. 15 is a top plan view of the pants hanger shown in FIG. 13.

The second leg 56D extends between the lower bend and a third turn 48D. The third turn 48D connects the actuator portion 26D to the second leg. Similar to the lower bend of hanger 16A, the lower bend 54D biases the first and second legs into a closed position. As generally illustrated in FIG. 16, when the clamp portion 24D is in the closed position, the second leg 56D is a predetermined distance 59 from a third turn 48D of the hanger.

The actuator portion 26D includes a trigger 68D of another embodiment of the present disclosure. In one embodiment, the third turn 48D is approximately 90 degrees. Accordingly, the trigger 68D may be oriented vertically and extend upwards from the third turn 48D.

In this embodiment, the user holds the spine 44D and puts a thumb on the trigger 68D of the actuator portion 26D. The user presses the trigger 68D away from the vertical plane 8D in the direction indicated by arrow 78. In response, the second leg 56D is pushed in direction 80 apart from the first leg 50D to place the clamp portion in the open position. The user may then insert the pants between the legs of the hanger. The user then releases the trigger 68D which allows the clamp portion 24D to return to its original closed position illustrated in FIGS. 15-16. The pants may then be folded over the second leg 56D.

This embodiment of the hanger 16D may also include the padding 74 described in conjunction with the hanger 16A generally illustrated in FIG. 1. The padding 74 may be formed over the actuator portion 26D and the clamp portion 24D. In one embodiment, one or more of the first leg 50D and the second leg 56D are at least partially covered in padding 74. To insert the pants, the user would press the trigger 68D and create a gap between first leg 50D and the second leg 56D. The user could then pinch the ends of the pant legs together and slide the pant legs through the opened gap in the legs. When the user releases the trigger 68D, the legs of the clamp portion 24D return to their original position such that the padding 74 clamps the pant legs so that they cannot be removed from the clamp portion 24D.

While various embodiments of the system have been described in detail, it is apparent that modifications and alterations of those embodiments will occur to those skilled in the art. It is to be expressly understood that such modifications and alterations are within the scope and spirit of the present disclosure. Further, it is to be understood that the phraseology and terminology used herein is for the purposes of description and should not be regarded as limiting. The use of "including," "comprising," or "having" and variations thereof herein are meant to encompass the items listed thereafter and equivalents thereof, as well as additional items.

To provide additional background, context, and to further satisfy the written description requirements of 35 U.S.C. § 112, the following reference are incorporated herein by reference in their entirety: U.S. Design Pat. Nos. D873,575; and D886,473.

What is claimed is:

1. A hanger for pants that is adapted to engage a support, comprising:

a hook portion to engage the support;

a handle portion connected to the hook portion, the handle portion comprising:

a first arm connected to the hook portion by a neck;

a second arm extending proximate to the first arm; and an upper bend connecting the first arm to the second arm, wherein the hook portion is positioned above the handle portion when the hook portion is engaged to the support;

a clamp portion connected to the handle portion, comprising:

a first leg connected to the handle portion, wherein the handle portion is positioned above the clamp portion when the hook portion is engaged to the support;

a second leg extending proximate to the first leg; and a lower bend connecting the first leg to the second leg, the first leg and the second leg being biased into a closed position by the lower bend such that a clamping force is created to hold the pants between the first leg and the second leg; and an actuator portion connected to the second leg and including a trigger, wherein the actuator portion is configured to move the clamp portion into an open position in response to a force applied in a lateral dimension to the trigger, the force causing the second leg to move in the lateral dimension away from the first leg, wherein the first arm is approximately parallel to the second arm, the first arm and the hook portion define a vertical plane, and the second arm is approximately parallel to the first leg, wherein the second arm and the first and second legs are on a first side of the vertical plane, and a spar of the actuator portion extends from the first side of the vertical plane to a second side of the vertical plane.

2. The hanger of claim 1, wherein the actuator portion includes:

a post extending away from the second leg;

the spar extending from the post; and the trigger extending from the spar.

3. The hanger of claim 1, wherein in the closed position a first turn at a beginning of the first leg is spaced a first distance from a second turn at an end of the second leg, and wherein in the open position the first turn is spaced a second distance from the second turn, the second distance being greater than the first distance.

4. The hanger of claim 1, wherein the handle portion is spaced from the clamp portion by a spine extending from the second arm downwardly to the first leg, the spine oriented in a vertical dimension.

5. The hanger of claim 1, wherein the first arm has a first length and the second arm has a second length that is greater than the first length, and the first leg has a leg length that is greater than the second length of the second arm.

6. The hanger of claim 1, wherein the lower bend extends between approximately 176° and approximately 184°.

7. The hanger of claim 1, wherein at least one of the first and second legs is straight.

8. The hanger of claim 1, wherein the hanger is formed of a single piece of a metal.

9. A hanger for receiving a garment, comprising:

a body extending from a first end to a second end, the body-having comprising:

a hook portion at the first end, wherein the hook portion defines a first vertical plane and is configured to engage a support;

an actuator portion at the second end, wherein the actuator portion traverses the first vertical plane;

a clamp portion between the hook portion and the actuator portion, wherein the clamp portion has a first leg and a second leg joined at a lower bend, and wherein the first and second legs define a horizontal plane that is perpendicular to the first vertical plane such that displacement of the actuator portion moves the second leg away from the first leg to receive the garment, and a handle portion between the hook portion and the clamp portion, wherein the handle portion has a first arm and a second arm joined at an upper bend, and the first and second arms are parallel to each other such that the handle portion is configured to receive a hand of a user while the actuator portion is configured to receive a thumb of the user to displace the actuator portion.

10. The hanger of claim 9, wherein the body comprises:

a spine extending upwardly from the first leg of the clamp portion to the handle portion; and a post extending upwardly from the second leg of the clamp portion to the actuator portion, wherein the post is longer than the spine such that the user can displace the actuator portion with the thumb while grasping the handle portion.

11. The hanger of claim 10, wherein the spine and the post form a second vertical plane that is perpendicular to the first vertical plane.

12. The hanger of claim 11, wherein a neck of the hook portion is a first distance from the second vertical plane, the upper bend is a second distance from the second vertical plane, and the lower bend is a third distance from the second vertical plane, wherein the third distance is greater than the second distance, and the second distance is greater than the first distance.

13. The hanger of claim 9, wherein at least one of the first leg and the second leg is straight.

14. The hanger of claim 9, wherein the hook portion comprises a neck extending from the handle portion to a hook at the first end, and the neck and the hook define the first vertical plane, and wherein the hook portion is approximately centered relative to a length of the first leg.

15. The hanger of claim 9, wherein the clamp portion and the second arm of the handle portion are positioned on one side of the first vertical plane, and a trigger of the actuator portion is positioned at the second end of the body and is positioned on an opposing side of the first vertical plane.

16. The hanger of claim 15, wherein the trigger is a button that has a larger cross-sectional diameter than the body and is connected to the second end of the body.

17. A hanger for a pair of pants that is adapted to hang from a support, comprising:

a hook to engage the support;

a neck extending downwardly from the hook;

a handle portion connected to the neck by a first turn, comprising:

a first arm extending from the first turn;

an upper bend extending in a lateral dimension from the first arm; and a second arm extending from the upper bend proximate to the first arm, wherein the handle portion is oriented approximately horizontally when the hanger is hanging from the support;

a spine connected to the second arm by a second turn, the spine extending downwardly below the second arm;

a clamp portion connected to the spine by a third turn, comprising:

a first leg extending from the third turn;

a lower bend extending in the lateral dimension from the first leg; and a second leg extending from the lower bend proximate to the first leg, wherein the clamp portion is oriented approximately horizontally below the handle portion when the hanger is hanging from the support;

a post connected to the second leg by a fourth turn, the post extending upwardly from the second leg, wherein the lower bend biases the second leg toward the first leg to a closed position of the clamp portion where the fourth turn is a first distance from the third turn;

a spar connected to the post by a fifth turn, the spar extending in the lateral dimension above the handle portion when the hanger is hanging from the support; and a trigger connected to the spar, wherein a force applied in the lateral dimension to the trigger will cause at least a portion of the second leg to move in the lateral dimension away from the first leg into an open position where the fourth turn is a second distance from the third turn, and the second distance is greater than the first distance.

* * * * *